US009368913B2

(12) United States Patent
Saito et al.

(10) Patent No.: US 9,368,913 B2
(45) Date of Patent: Jun. 14, 2016

(54) ELECTRICAL CONNECTOR FOR SUPPRESSING CROSSTALK

(71) Applicant: 3M INNOVATIVE PROPERTIES COMPANY, St. Paul, MN (US)

(72) Inventors: Shinji Saito, Tokyo (JP); Takayuki Hayauchi, Kanagawa (JP); Yoshihisa Kawate, Tokyo (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/348,911

(22) PCT Filed: Oct. 25, 2012

(86) PCT No.: PCT/US2012/061861
§ 371 (c)(1),
(2) Date: Apr. 1, 2014

(87) PCT Pub. No.: WO2013/063233
PCT Pub. Date: May 2, 2013

(65) Prior Publication Data

US 2014/0242827 A1 Aug. 28, 2014

(30) Foreign Application Priority Data

Oct. 28, 2011 (JP) ..... 2011-237655

(51) Int. Cl.
*H01R 13/646* (2011.01)
*H01R 13/506* (2006.01)
(Continued)

(52) U.S. Cl.
CPC ..... *H01R 13/646* (2013.01); *H01R 13/506* (2013.01); *H01R 13/516* (2013.01);
(Continued)

(58) Field of Classification Search
CPC ..... H01R 23/025; H01R 13/6272; H01R 2201/16; H01R 13/658; H01R 9/091
USPC ..... 439/344, 620.57, 79
See application file for complete search history.

(56) References Cited

U.S. PATENT DOCUMENTS 5,993,236 A 11/1999 Vanderhoof et al.
6,162,089 A 12/2000 Costello et al.
(Continued)

FOREIGN PATENT DOCUMENTS

DE 10057833 B4 2/2006
JP 2010-277861 12/2010

OTHER PUBLICATIONS

PCT International Search Report for PCT/US2012/061861 mailed on Feb. 2, 2013, 6 pages.

*Primary Examiner* — Abdullah Riyami
*Assistant Examiner* — Justin Kratt
(74) *Attorney, Agent, or Firm* — Robert S. Moshrefzadeh

(57) ABSTRACT

[Problem] To provide an electrical connector that suppresses cross-talk. [Resolution Means] An electrical connector includes a main body 14 and a cover 16, with the main body 14 and the cover 16 demarcating a space housing a cable 3; the main body 14 includes an upper housing 20, a lower housing 22, a wiring substrate 28 arranged between the upper housing 20 and the lower housing 22, and a shield member 30 arranged interposing the upper housing 20 and the lower housing 22; and the wiring substrate 28 includes a contact 24 for electrically connecting to the cable 3, a connection terminal 26 for electrically connecting to a mating connector, and connecting conductor wiring L for electrically connecting the contact 24 and the connection terminal 26.

18 Claims, 23 Drawing Sheets

(51) Int. Cl.

| | |
|---|---|
| ***H01R 13/516*** | (2006.01) |
| ***H01R 13/6581*** | (2011.01) |
| ***H01R 24/64*** | (2011.01) |
| *H01R 24/00* | (2011.01) |
| *H01R 13/627* | (2006.01) |
| *H01R 13/7197* | (2011.01) |
| *H01R 13/658* | (2011.01) |
| *H01R 12/00* | (2006.01) |

(52) U.S. Cl.

CPC ..... *H01R13/6581* (2013.01); *H01R 24/64* (2013.01); *H01R 9/091* (2013.01); *H01R 13/6272* (2013.01); *H01R 13/658* (2013.01); *H01R 13/7197* (2013.01); *H01R 23/025* (2013.01); *H01R 2201/04* (2013.01); *H01R 2201/16* (2013.01)

(56) References Cited

U.S. PATENT DOCUMENTS

| | | | | |
|---|---|---|---|---|
| 6,231,392 | B1 | 5/2001 | van Woensel | |
| 6,244,908 | B1 * | 6/2001 | Hammond | H01R 13/7031 200/51.03 |
| 7,874,849 | B2 | 1/2011 | Sticker et al. | |
| 2004/0043654 | A1 * | 3/2004 | Lee | H01R 13/6275 439/358 |
| 2006/0014431 | A1 | 1/2006 | Shuey et al. | |
| 2010/0093208 | A1 * | 4/2010 | Hamner | H01R 13/65802 439/541.5 |
| 2012/0021636 | A1 | 1/2012 | Debenedictis et al. | |

* cited by examiner

ELECTRICAL CONNECTOR FOR SUPPRESSING CROSSTALK

BACKGROUND

1. Technical Field

The present invention relates to an electrical connector.

2. Related Art

An RJ plug connector disclosed in Japanese Translation of Published PCT Application No. 2009-528654, for example, is known as an electrical connector attached to a communication cable.

Japanese Translation of Published PCT Application No. 2009-528654 describes a plug for a shielded data cable, in other words a plug that includes a conductive housing that combines a first shell and a second shell; an electrically insulated plug body that houses plug contact points; a printed circuit board; and a surface loading component. The printed circuit board can be inserted into the housings, which are electrically connected together supporting the plug contact points and insulation displacement contact points. Also, a core wire of the data cable can be inserted into the loading component. The plug can be inserted into the printed circuit board so the loading component makes contact with the core wire at the insulation displacement contact points. The printed circuit board can be inserted into the first shell, to be electrically insulated from the first shell bottom surface by a film, with the insulation displacement contact points lined up in mutually shifted positions arranged in two rows. When viewed from the insertion direction, the height of the insulation displacement contact points in the back row is lower than the insulation displacement contact points in the front row. The loading component receives the core wire at two flat faces arranged by positioning the core wire terminal in a stepped shape. Also, the core wire of the projecting flat face is connected to the row of the insulation displacement contact points.

BACKGROUND DOCUMENTS

Patent Documents

Patent document 1: Japanese Translation of Published PCT Application No. 2009-528654

SUMMARY OF THE INVENTION

Problems to be Solved by the Invention

However, with an electrical connector that is attached to a communication cable such as a LAN (Local Area Network) cable, it is preferred that there is reduced cross-talk from the viewpoint of communication quality. For that reason, it is very important to suppress cross-talk between the wiring substrate and the cable when the cable is attached to the electrical connector.

An object of the present invention is to provide an electrical connector that can suppress cross-talk.

SUMMARY

One aspect of the present invention is an electrical connector connected to a cable, including a main body, and a cover, with the main body and the cover demarcating a space for housing the cable. The main body includes an upper housing, a lower housing, a wiring substrate arranged between the upper housing and the lower housing, and a shielding member arranged interposing the upper housing and the lower housing. The wiring substrate includes a contact for electrically connecting to the cable, a connection terminal for electrically connecting to a mating connector, and wiring that electrically connects the contact and the connection terminal.

Effect of the Invention

According to the present invention, the shielding members are arranged to interpose the upper housing and the lower housing of the main body that hold the wiring substrate. For that reason, when the cable is housed in the space demarcated by the main body and the cover, the shielding members suppress electrical interference between the conductor on the wiring substrate and the cable, and suppress cross-talk between the wiring substrate and the cable.

DETAILED DESCRIPTION

Preferred embodiments pursuant to the present invention will now be explained in detail below, referencing the appended drawings. Note that in the description of the drawings, identical or corresponding elements are designated using the same symbols and overlapping descriptions will be omitted.

Figure 1B:
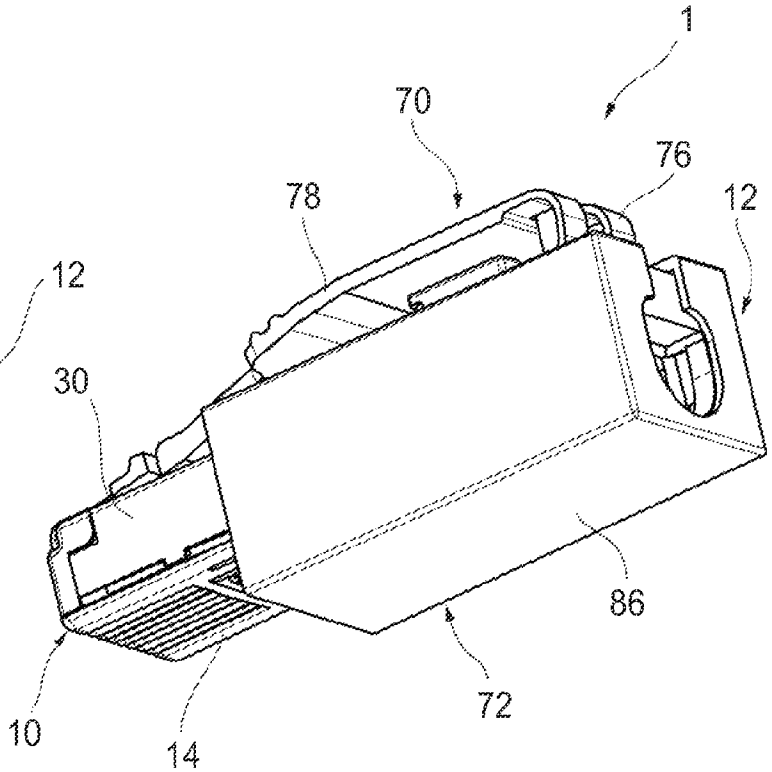
FIG. 1B is a perspective view of the electrical connector according to an embodiment of the present invention seen from below.
Figure 1A:
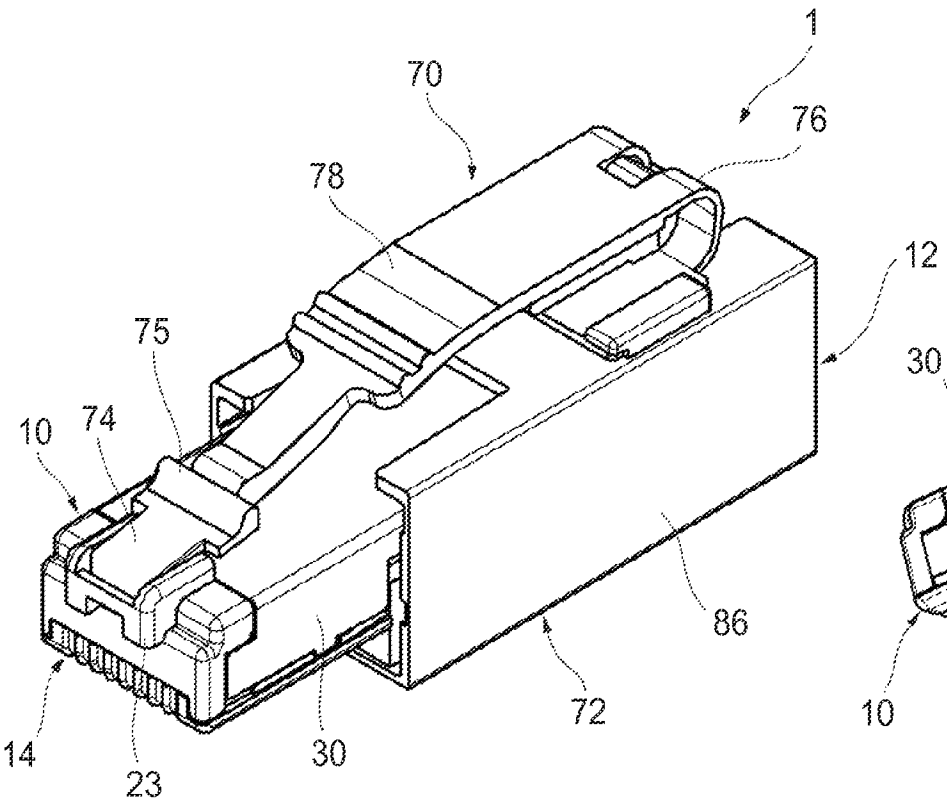
FIG. 1A is a perspective view of an electrical connector according to an embodiment of the present invention seen from above.
Figure 2A:
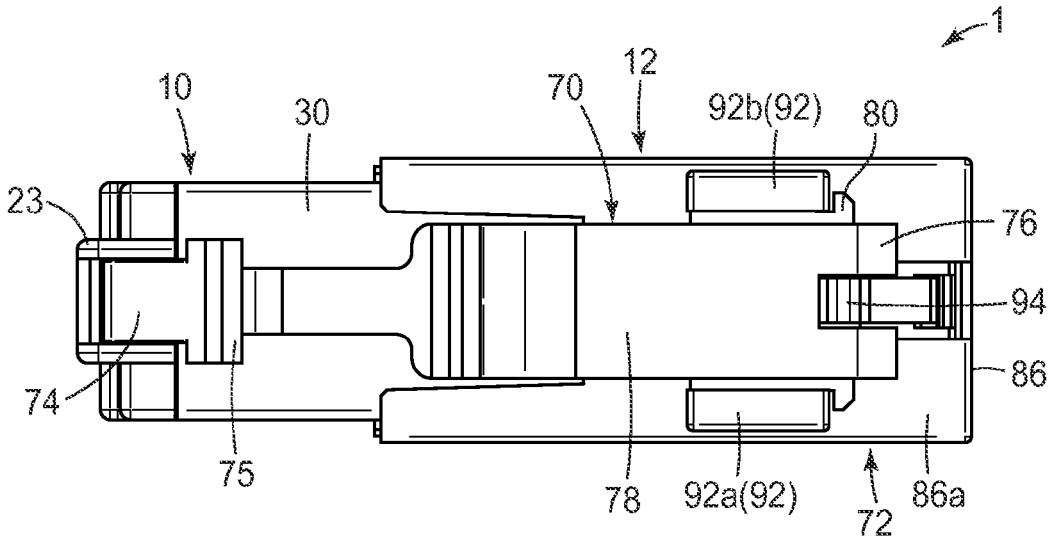
FIG. 2A is a view of the electrical connector shown in FIGS. 1A and 1B seen from above.
Figure 2B:
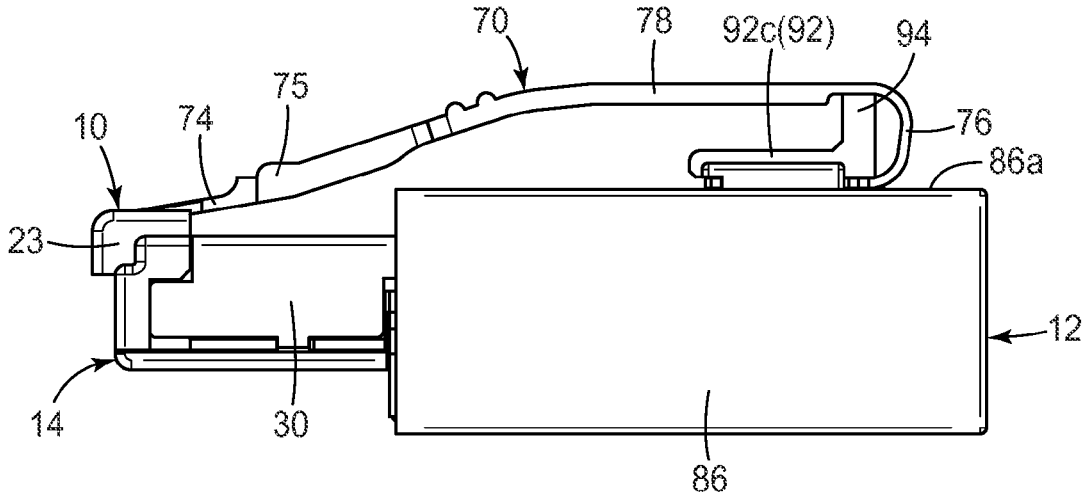
FIG. 2B is the electrical connector shown in FIGS. 1A and 1B seen from a side.
Figure 3:
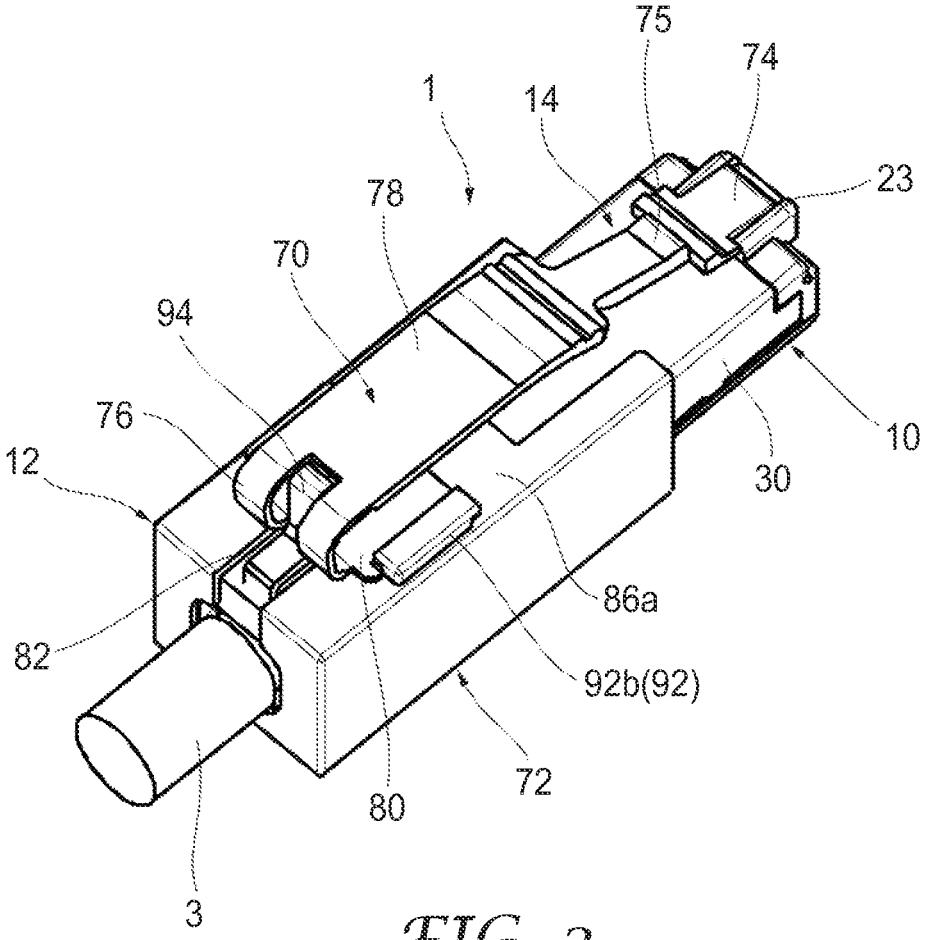
FIG. 3 is a perspective view illustrating a cable attached to the electrical connector shown in FIG. 1.
Figure 4:
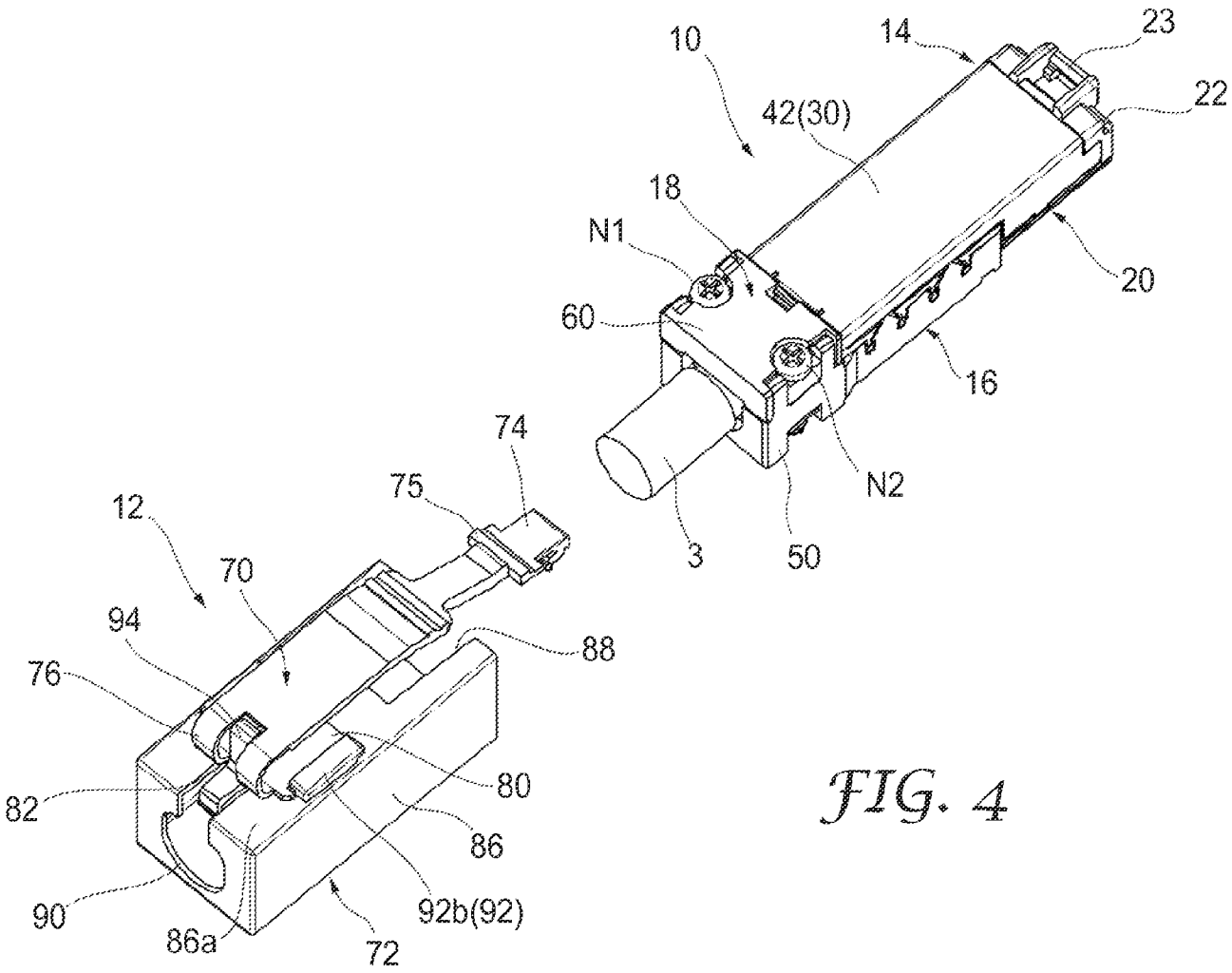
FIG. 4 is a perspective view of a module and a case.

FIG. 1A is a perspective view of an electrical connector according to an embodiment seen from above; FIG. 1B is a perspective view of the electrical connector according to the embodiment seen from below. FIG. 2A is a view of the electrical connector shown in FIGS. 1A and 1B seen from above; FIG. 2B is the electrical connector shown in FIGS. 1A and 1B seen from the side. FIG. 3 is a perspective view illustrating the electrical connector shown in FIG. 1 in a state with a cable attached. FIG. 4 is a perspective view of a module and a case.

The electrical connector 1 shown in FIGS. 1 and 2 is an RJ (Registered Jack)-45 connector standardized for ISO/IEC8877, for example. It is attached to a terminal on cable 3. The cable 3 is a communication cable, for example an LAN (Local Area Network) cable, that includes a 4×8 core twisted pair cable 5 (see FIG. 10), and a shield 7 (see FIG. 10) that covers an outside of the entire external periphery of the twisted pair cable 5.

Figure 5:
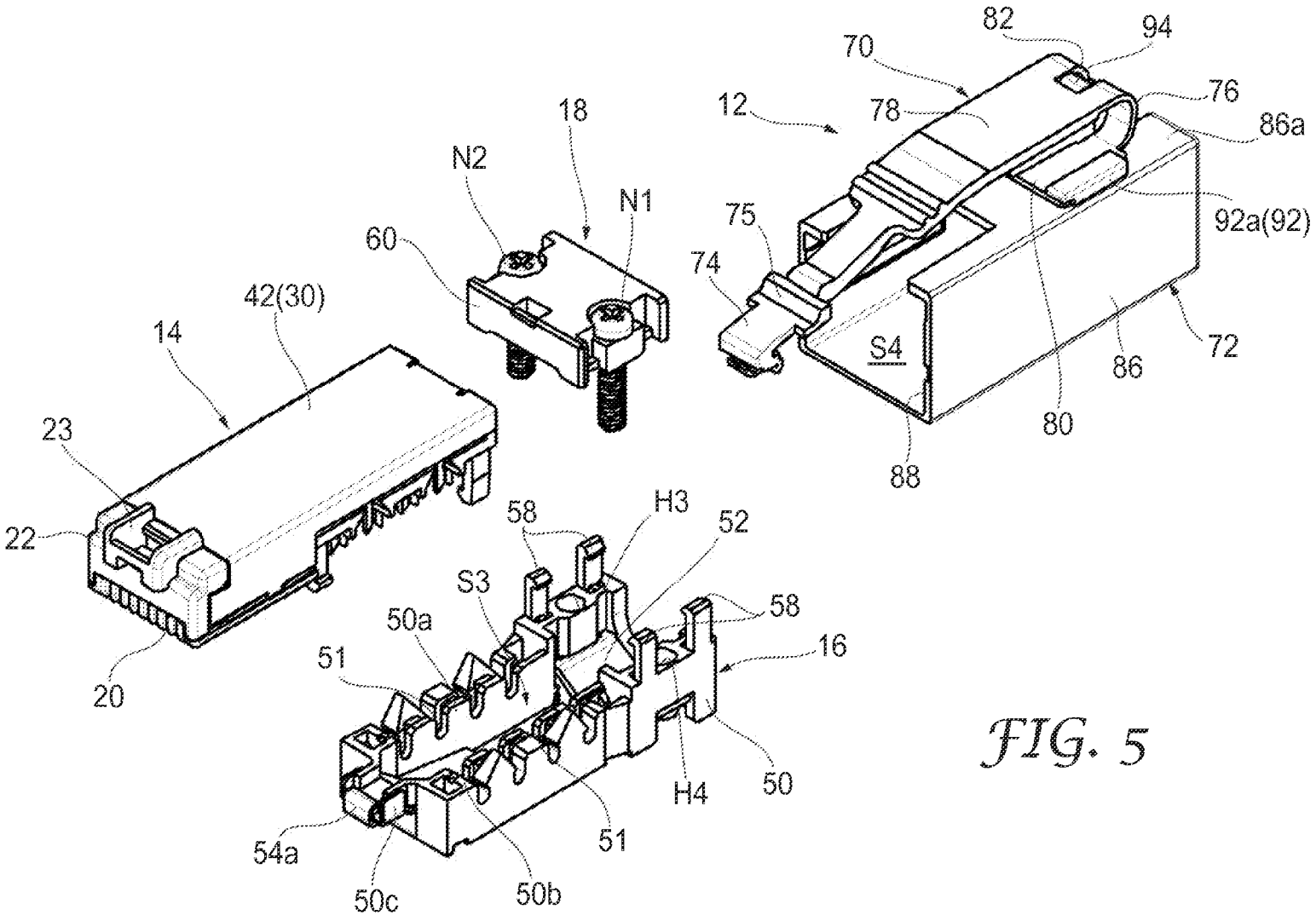
FIG. 5 is an exploded perspective view of the electrical connector illustrated in FIG. 1.
Figure 6B:
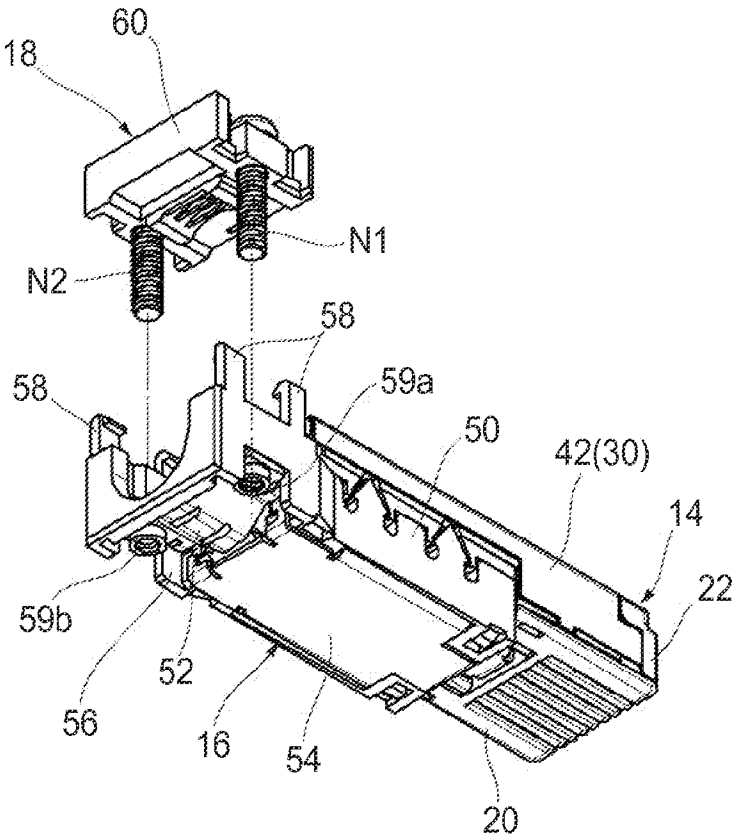
FIGS. 6A and 6B are perspective views that illustrate the attachment of a plug.
Figure 6A:
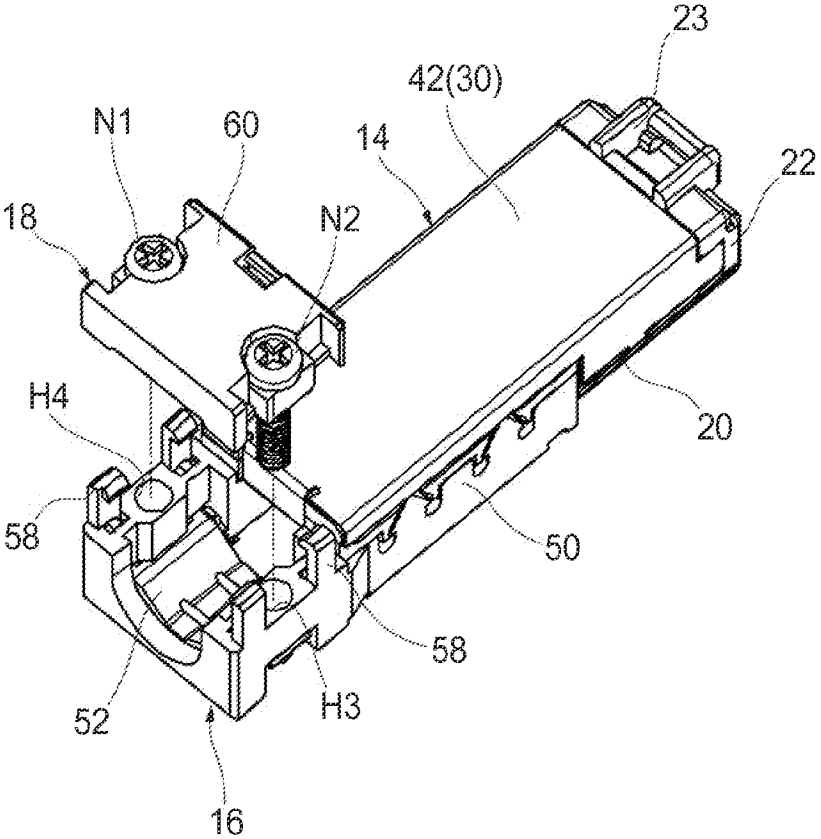

The electrical connector 1 is equipped with a module 10 and a case 12. FIG. 5 is an exploded perspective view of the electrical connector illustrated in FIG. 1. FIGS. 6A and 6B are perspective views that illustrate the attachment of a plug. As shown in FIGS. 5 and 6, the module 10 includes a main body 14, a cover 16, and a clamp 18. The main body 14 and the cover 16 demarcate a storage space for storing the cable 3.

Figure 7:
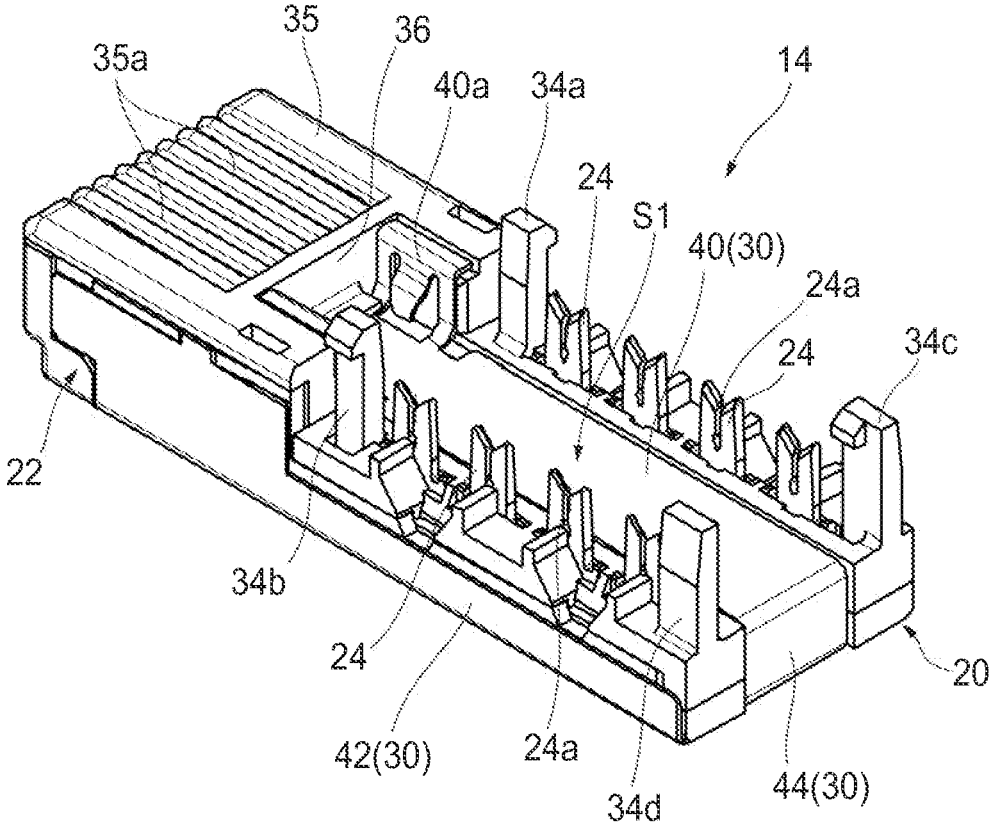
FIG. 7 is a perspective view of a main body.
Figure 8:
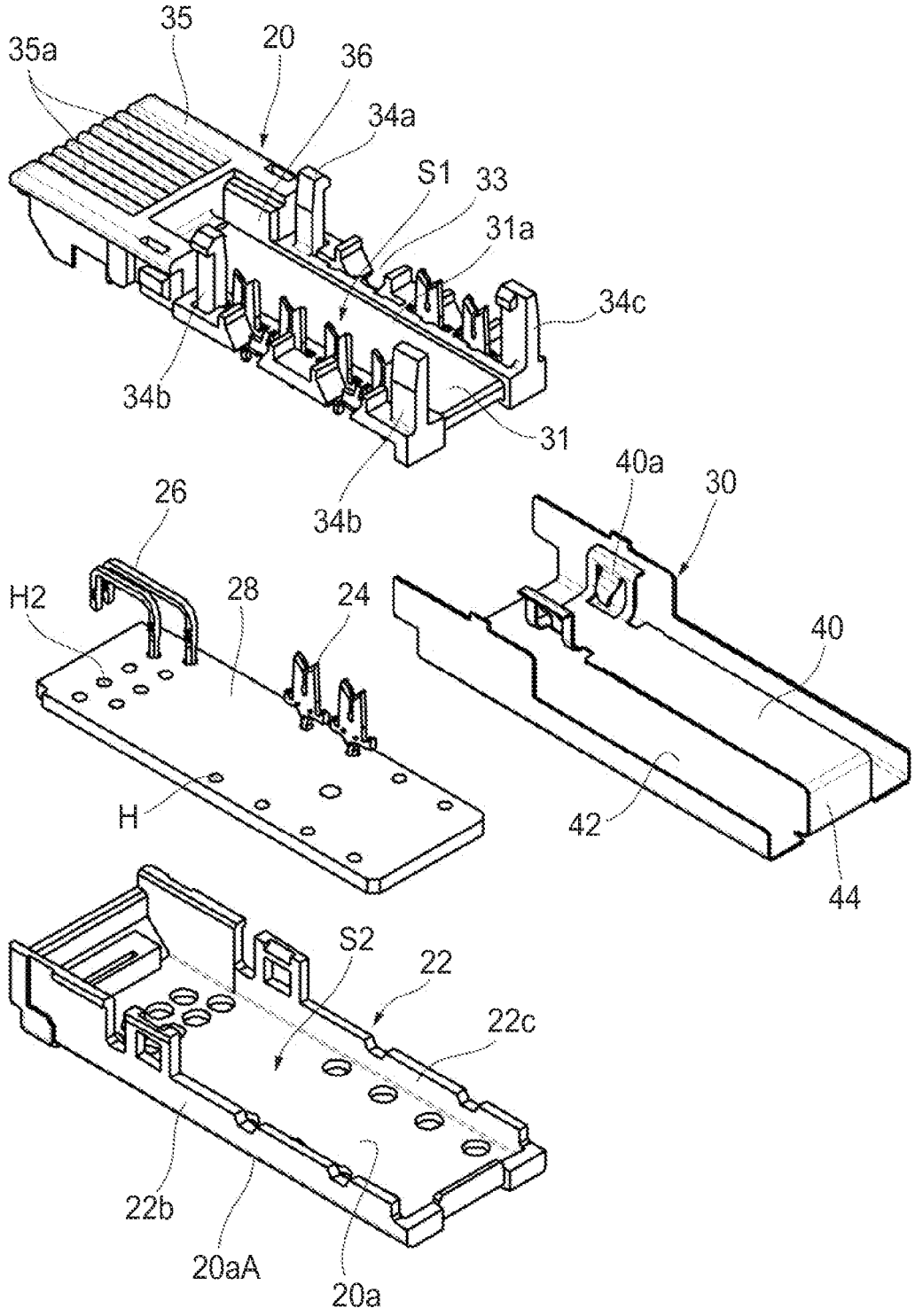
FIG. 8 is an exploded perspective view of the main body shown in FIG. 7.

FIG. 7 is a perspective view of the main body. FIG. 8 is an exploded perspective view of the main body shown in FIG. 7. The main body 14 includes an upper housing 20, a lower housing 22, a wiring substrate 28, and a first shield member 30.

The upper housing 20 is formed from an industrial-use plastic material, such as PBT (polybutylene terephthalate), PA (polyamide), or the like, for example. The upper housing 20 is configured from a housing 31, a contact holder 33, and a connector 35. The upper housing 20 is integrated with the housing 31, the contact holder 33, and the connector 35, using an injection molding method, for example.

The housing 31 demarcates a storage space S1 where the twisted pair cable 5 is housed. The housing 31 has a plate shape, and seen from above, is substantially rectangular in form. One face 31*a* of the housing 31 (an upper face) is a flat surface.

The contact holders 33 are portions that fasten and hold contacts 24 as described below. The contact holders 33 are provided along the length direction of the housing 31 on both sides of the housing 31. Specifically, the contact holders 33 are arranged at predetermined intervals (evenly spaced) along the length direction of the housing 31, and are arranged at opposing positions along the width direction of the housing 31. Note that a plurality (in this case, four) of locking portions 34*a* to 34*d* that lock the cover 16 are provided at positions to interpose therebetween the contact holders 33 arranged along the length direction of the housing 31 on the upper housing 20.

The connector 35 is a component for inserting into a plug insertion port (not shown) in a modular jack targeted for connection. The connector 35 is provided at one end (a front-end side) of the housing 31. The connector 35 houses connection terminals 26, described below, and holds the connection terminal 26. Grooves 35*a* that expose the connection terminals 26 are provided in the connector 35. Grooves 35*a* extend in the length direction of the main body 14, and are arranged at predetermined spacing in the width direction. Also, a positioning unit 36 provided with a locking portion 40*a* in the first shield member 30, described below, is arranged at a trailing end of the connector 35.

The lower housing 22 is formed from an industrial-use plastic material, such as polybutylene terephthalate, polyamide, or the like, for example. The lower housing 22 is composed of a bottom portion 22*a*, upon which the wiring substrate 28 is placed, and side members 22*b* and 22*c* that are erected vertically from both sides of the bottom portion 22*a*. The bottom portion 22*a* and the side portions 22*b* and 22*c* demarcate a storage space S2 that houses the wiring substrate 28. Moreover, as shown in FIG. 5, an arm fastening portion 23 that fastens a leading end portion 74 of the arm 70 of the case 12, described below, is arranged at one end (a front end) of the lower housing 22.

The wiring substrate 28 includes a plurality (in this case, 8) of the contacts 24; a plurality (in this case, 8) of the connection terminals 26; and connecting conductor wiring (wire) L that electrically connects the contacts 24 and the connection terminals 26. The wiring substrate 28 is arranged between the upper housing 20 and the lower housing 22. The wiring substrate 28 is housed in the storage space S2 in the lower housing 22 and is held between the upper housing 20 and the lower housing 22. The wiring substrate 28 is a printed circuit board (also known as a PCB), for example.

The contact 24 and the connection terminal 26 will now be described. The contact 24 is composed of an electrically conductive material, such as metal and the like, and has a two-pronged shape formed with a slit 24*a*. By inserting (press-fitting) the twisted pair cable 5 into the slit 24*a* in the contact 24, the twisted pair cable 5 is electrically connected to the contact 24. In other words, the contact 24 cuts into the jacket cover of the twisted pair cable 5, and the contact 24 is electrically connected by reaching the conductor wire of the twisted pair cable 5. The contact 24 is held by the contact holder 33, and one end thereof (a bottom end) is inserted into a first insertion hole H1 on the wiring substrate 28. As shown in FIG. 8, the contact 24 projects in a direction away from the face of the wiring substrate 28, in other words, projects in an upward direction.

A connection terminal 26 electrically connects with each contact on the modular jack, in other words, the connector on the mating side, for one-to-one continuity with the contact. The connection terminal 26 is arranged in the connector 35. The connection terminal 26 is substantially U-shaped. One end of the connection terminal 26 is anchored to the wiring substrate 28 by being inserted into a second insertion hole H2 in the wiring substrate 28. The connection terminal 26 is arranged along the groove 35*a* in the connector 35, and the exposed portion in the groove 35*a* is the contact portion.

Figure 9:
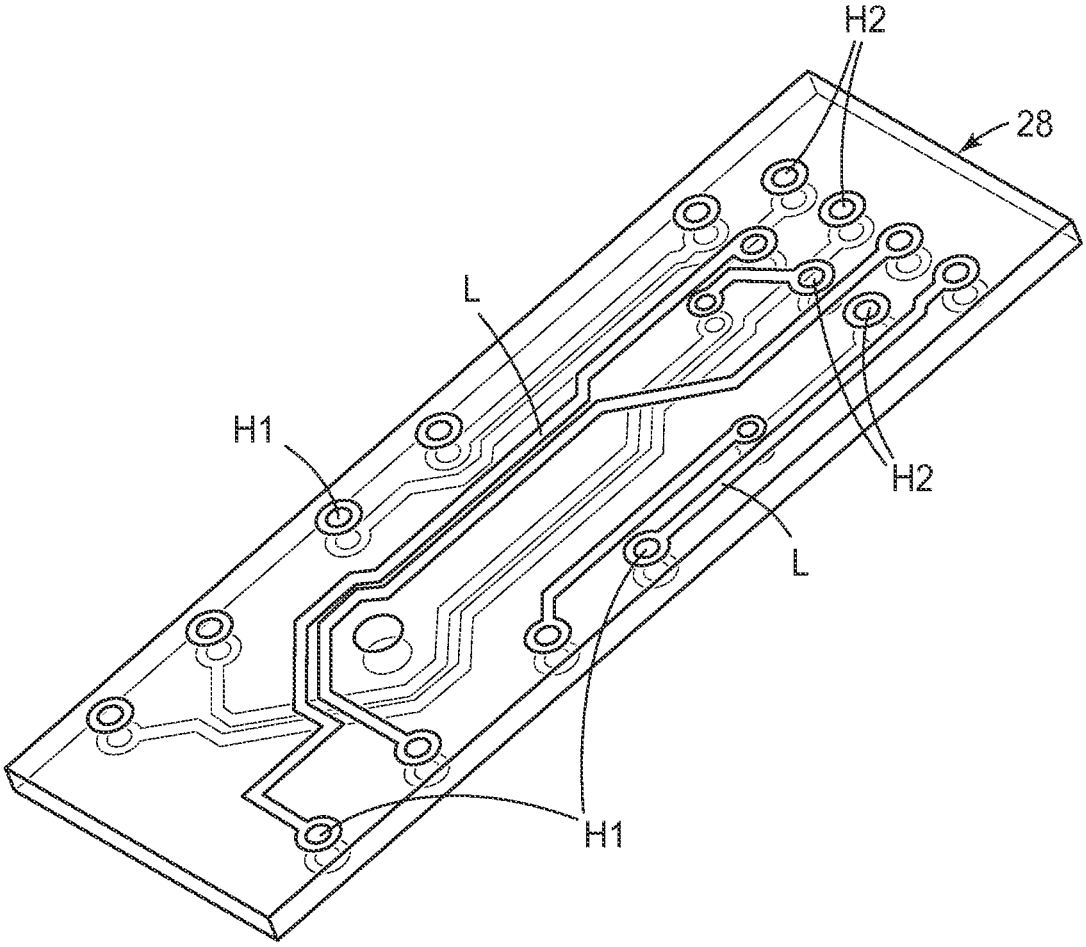
FIG. 9 is a perspective view of a wiring substrate.

FIG. 9 is a perspective view of a wiring substrate. As shown in FIG. 9, the wiring substrate 28 is substantially rectangular-shaped and has a predetermined thickness. A plurality (in this case, 8) of the first insertion holes H1 (with one end of the contact 24 inserted therein) and of the second insertion holes H2 (with one end of the connection terminal 26 inserted therein) are formed respectively in the wiring substrate 28. The first insertion holes H1 are arranged at a predetermined spacing in the length direction on both edges of the wiring substrate 28 in the width direction. The first insertion hole H1 is a through hole and an inner surface of this first insertion hole H1 is plated.

The second insertion hole H2 is arranged in a zig-zag pattern at one end of the wiring substrate 28 in the length direction. The second insertion hole H2 is a through hole and an inner surface of this second insertion hole H2 is plated. The predetermined first insertion holes H1 and the predetermined second insertion holes H2 are each electrically connected by the connecting conductor wiring L. The contacts 24 and the connection terminals 26 are electrically connected by the connecting conductor wiring L.

The first shield member 30 is a member that suppresses cross-talk between the twisted pair cable 5 of the cable 3 and the connecting conductor wiring L of the wiring substrate 28. The first shield member 30 is formed using SUS301 or something similar, for example. The first shield member 30 includes a first portion arranged at a top side of the upper housing 20 and between opposing contacts 24, and a second portion arranged at a lower side of the lower housing 22. In other words, the first shield member 30 is composed of an upper portion (the first portion) 40, a lower portion (the second portion) 42, and a linking portion 44 that links the upper portion 40 and the lower portion 42. The upper portion 40, the lower portion 42, and the linking portion 44 are formed into one body on the first shield member 30 using a plate. The first shield member 30 is attached to the upper housing 20 and the lower housing 22, interposing the upper housing 20 and the lower housing 22.

The upper portion 40 is a flat, plate-shaped member, and has a thickness on the order of 0.1 mm to 0.6 mm, for example. The upper portion 40 has a width dimension that is substantially the same width dimension as the housing 31 in the upper housing 20. The upper portion 40 contacts a face of the upper face 31*a* in the housing 31, arranged opposite of the housing 31, to cover the housing 31 of the upper housing 20 between the opposing contacts 24. The locking portion 40*a* that locks with a locking portion 54*a* on the shield member 54, described below, is provided at one end of the upper portion 40. The locking portion 40*a* is arranged in the positioning unit 36 on the upper housing 20.

The lower portion 42 is substantially U-shaped in a cross-section. The lower portion 42 is arranged at the bottom face 22*a* side of the lower housing 22, contacting planarly with the bottom face 22*a*, and covers an outer face of side faces 22*b* and 22*c* on the lower housing 22. The lower portion 42 has a larger width dimension than the upper portion 40. The upper portion 40 and the lower portion 42 are provided in a linked manner by being folded at the linking portion 44, separated in up and down directions at a predetermined spacing, and are arranged in parallel to be mutually opposed. The linking portion 44 has substantially the same width dimension as the upper portion 40.

Figure 11A:
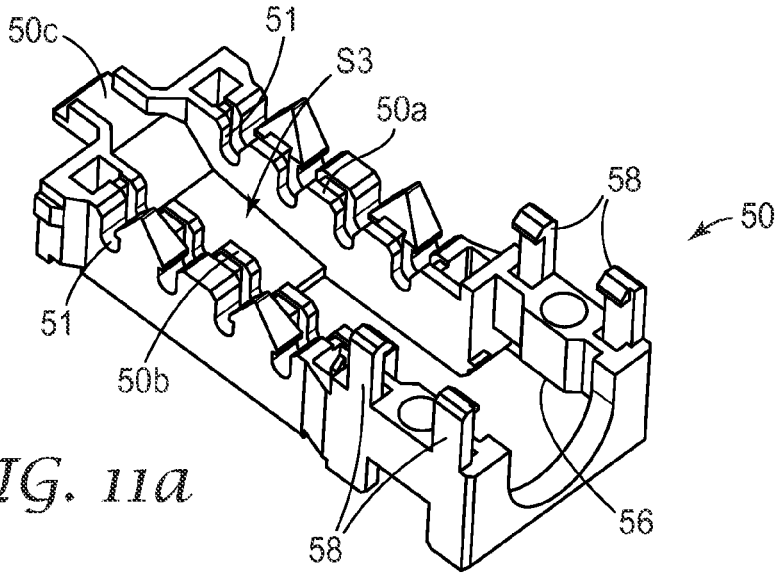
FIGS. 11A through 11C are perspective views of a cover.
Figure 11B:
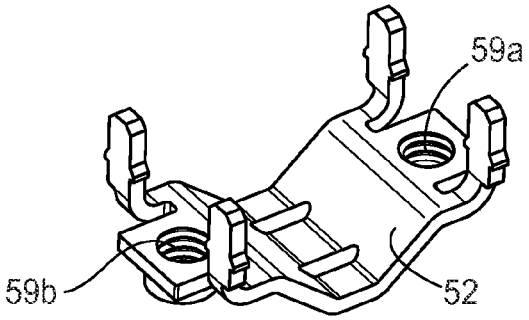
Figure 11C:
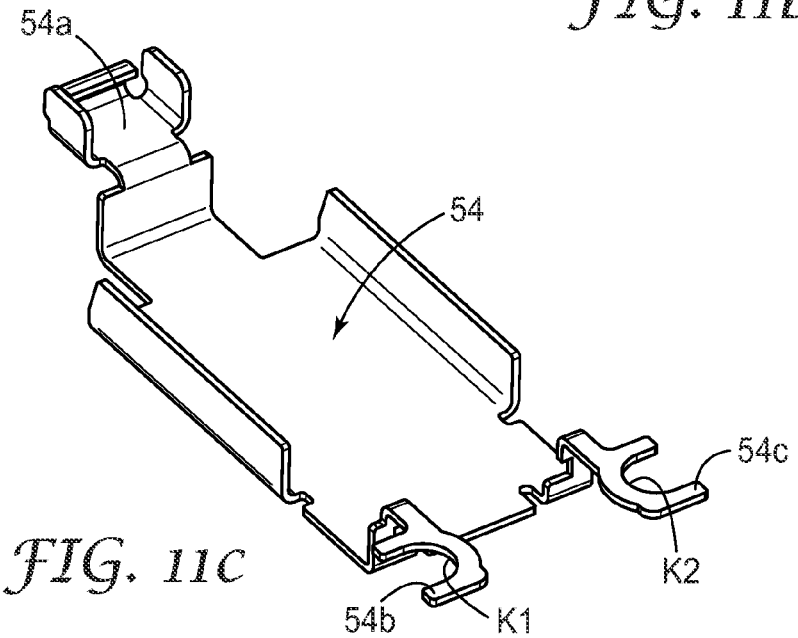

FIGS. 11A through 11C are perspective views of a cover. As shown in FIG. 11, the cover 16 includes a wire guide 50, a cable bearing 52, and the second shield member 54. The wire guide 50 is formed from an industrial-use plastic material, such as polybutylene terephthalate, polyamide, or the like, for example. The wire guide 50 has side portions 50*a* and 50*b* that demarcate a storage space S3 that houses the twisted pair cable 5. The side portions 50*a* and 50*b* are arranged to oppose each other, and guide grooves 51 in which the twisted pair cable 5 of the cable 3 is arranged are formed in the side portions 50*a* and 50*b*. The guide grooves 51 are arranged at a predetermined spacing along a length direction of the side portions 50*a* and 50*b*. The guide grooves 51 are provided in positions where the contacts 24 are arranged. In other words, they are provided at positions that correspond to the contact holder 33 of the upper housing 20.

A positioning unit 56 with the cable bearing 52 arranged therein is provided at one end in the length direction of the wire guide 50. Locking portions 58 that lock the clamp 18 are provided in the positioning unit 56. The locking portions 58 are arranged to oppose each other in the length direction of the wire guide 50, and are arranged to oppose each other in the width direction. Specifically, the locking portions 58 are arranged at four of the positioning units 56. Two through holes H3 and H4 are formed in positions in the positioning unit 56 that correspond to screw holes 59*a* and 59*b* in the cable bearing 52, described below. Also, a mating portion 50*c* that mates with the locking portion 54*a*, described below, on the second shield member 54 is arranged at another end of the wire guide 50 in the length direction.

The cable bearing 52 has a thickness of approximately 0.6 mm, and is formed from a material such as SUS (Steel Use Stainless: Stainless Steel). The cable bearing 52 is arranged in the positioning unit 56 of the wire guide 50, and together with the clamp 18, interposes the cable 3 therebetween to hold the cable 3. Two screw holes 59*a* and 59*b* are formed in both ends of the cable bearing 52 to thread screws N1 and N2 of the clamp 18, described below. The cable bearing 52 has a physical electrical connection to the shield 7 exposed when the jacket cover of the cable 3 is removed. In other words, the shield 7 of the cable 3 and the cable bearing 52 have the same electric potential (grounding potential).

The second shield member 54 has a thickness on the order of 0.1 mm to 0.6 mm, for example, and is formed by a material such as SUS or similar material. The second shield member 54 is arranged below the wire guide 50. The locking portion 54*a* that locks the locking portion 40*a* of the first shield member 30 is provided at one end of the second shield member 54. The locking portion 54*a* mates with a mating portion 50*c* of the wire guide 50 and holds the wire guide 50.

A pair of contact portions 54*b* and 54*c* are provided at another end of the second shield member 54, and are physically and electrically connected to the cable bearing 52. The contact portions 54*b* and 54*c* are provided between the wire guide 50 and cable bearing 52 in the positioning unit 56 on the wire guide 50. In other words, the second shield member 54 is held by the wire guide 50, through an arrangement with the contact portions 54*b* and 54*c* held between the wire guide 50 and the cable bearing 52. Openings K1 and K2 are provided in the contact portions 54*b* and 54*c*, through which screws N1 and N2 are inserted.

By locking the locking portion 40*a* of the first shield member 30 together with the locking portion 54*a* of the second shield member 54, the first shield member 30 and the second shield member 54 are physically and electrically connected. In other words, the first shield member 30 and the second shield member 54 have the same electric potential. Also, the pair of contact portions 54*b* and 54*c* on the second shield member 54 and the cable bearing 52 are physically and electrically connected. In other words, the shield member 54 and the cable bearing 52 have the same electric potential, and the second shield member 54 and the shield 7 of the cable 3 have the same electric potential (grounding potential).

The clamp 18 is a component that fastens the cable 3 to the cover 16. The clamp 18 is composed of a cable clamp 60 and a plurality (in this case, two) of screws N1 and N2. Two through holes (not shown) wherein screws N1 and N2 are threaded, are provided at both ends of the cable clamp 60. As shown in FIG. 6, the cable clamp 60 is arranged at a position that corresponds to the cable bearing 52 for the cover 16, and is fastened by locking with the locking portion 58 of the cover 16. Also, the screws N1 and N2 are threaded into the screw holes 59*a* and 59*b* in the cable bearing 52 via the through holes H3 and H4 in the wire guide 50. The cable 3 is fastened to the module 10, interposed between the cable bearing 52 and the cable clamp 60.

Also, a seal M (see FIG. 19C) is affixed to the cable clamp 60 before assembly. A view is provided to illustrate the position of the seal M where the twisted pair cable 5 is arranged, in other words, the position where the twisted pair cable 5 is inserted into the contact 24. With this, the operations for inserting the twisted pair cable 5 into the contact 24 are improved. Also, the seal M is held on the cable clamp 60 by the screws N1 and N2. Therefore, this prevents losing the screws N1 and N2, so the work to insert the screws into the cable clamp 60 can be omitted.

Figure 12A:
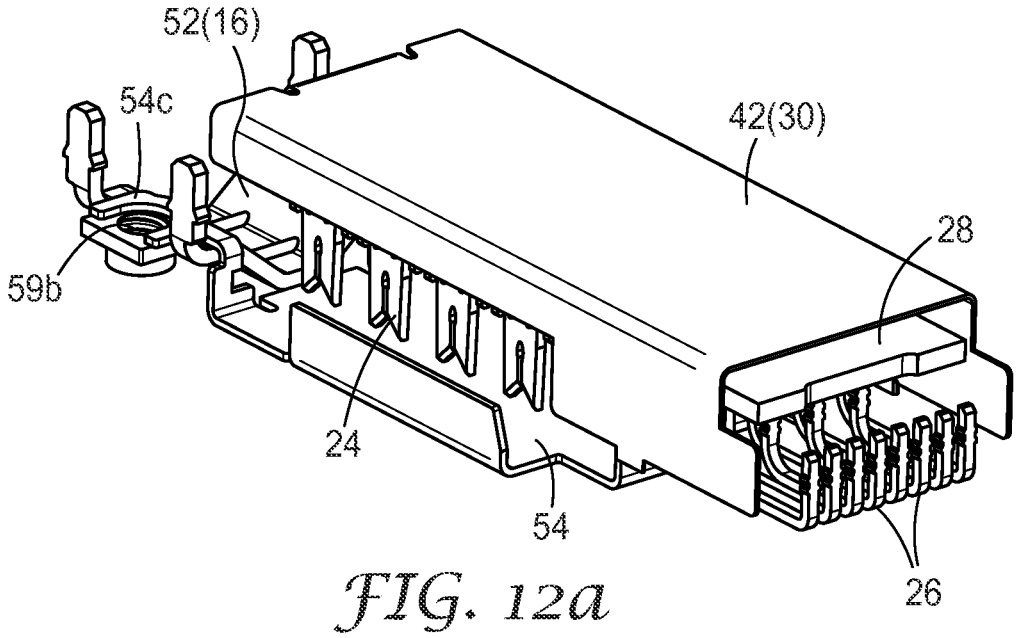
FIGS. 12A and 12B are perspective views of the wiring substrate and a ground structure.
Figure 12B:
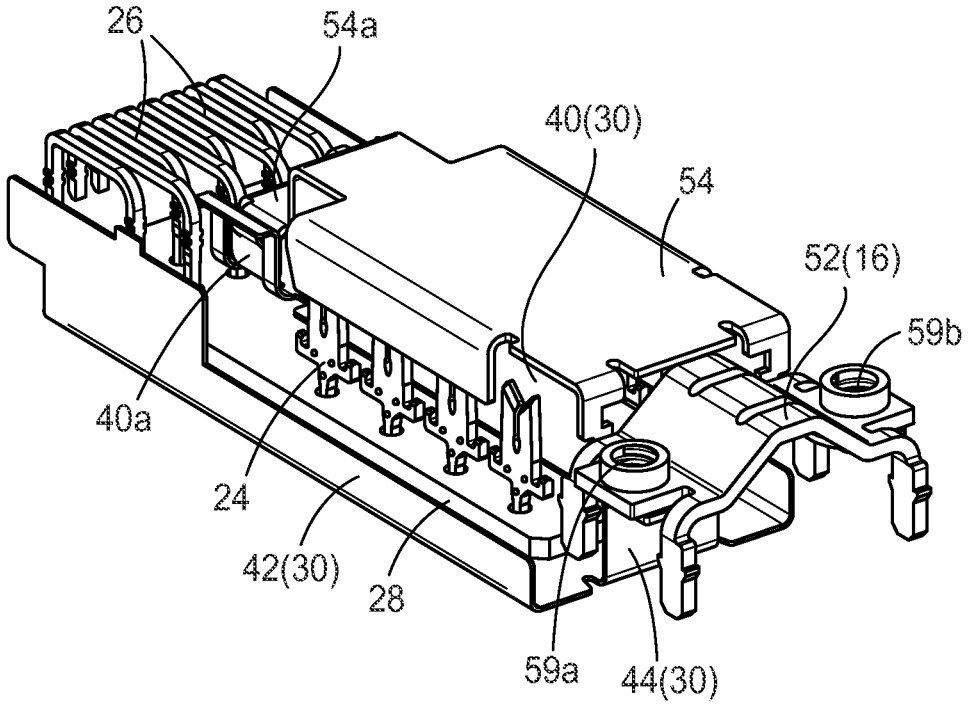
Figure 13A:
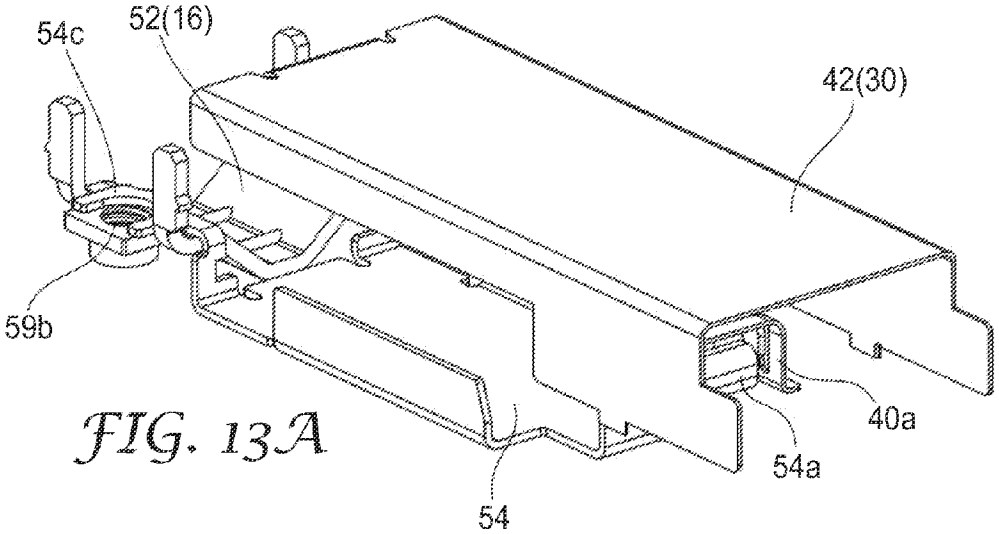
FIGS. 13A and 13B are views of the ground structure.
Figure 13B:
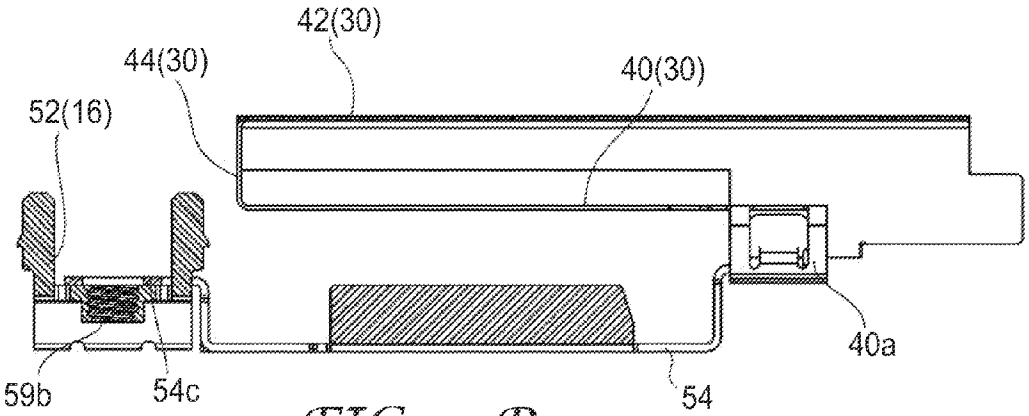
Figure 14:
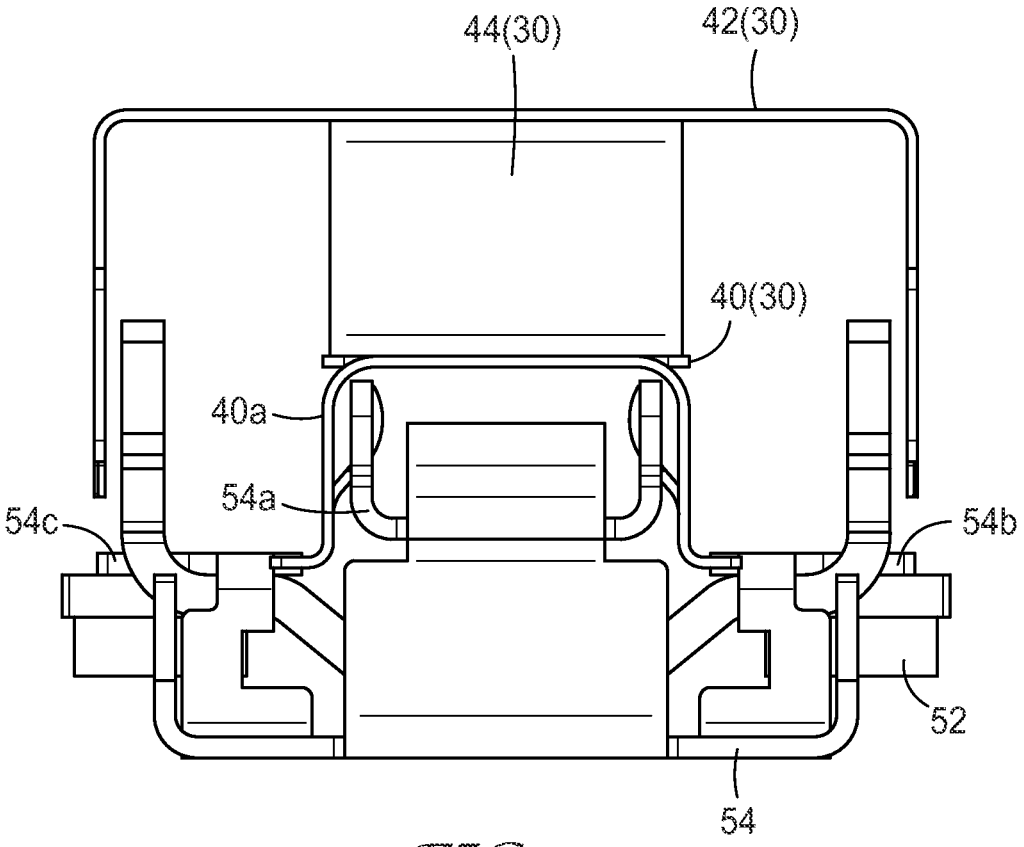
FIG. 14 is a view from a front of the ground structure shown in FIG. 13A.

FIGS. 12A and 12B are views of a circuit board and a ground structure. FIGS. 13A and 13B are views of the ground structure. FIG. 14 is a view from a front of the ground structure shown in FIG. 13A.

As shown in FIGS. 12 to 14, the first shield member 30, the second shield member 54, and the cable bearing 52 are electrically connected. Specifically, the first shield member 30 and the second shield member 54 are physically and electrically connected by the locking portion 40*a* and the locking portion 54*a* being locked. The second shield member 54 and the cable bearing 52 are physically and electrically connected by the contact portions 54*b* and 54*c* of the second shield member 54 and the cable bearing 52 making contact.

With this configuration for the electrical connector 1, the first shield member 30, the second shield member 54, and the cable bearing 52 have the same electric potential (ground potential) as the shield 7 on the cable 3, when the cable 3 is connected.

Figure 15A:
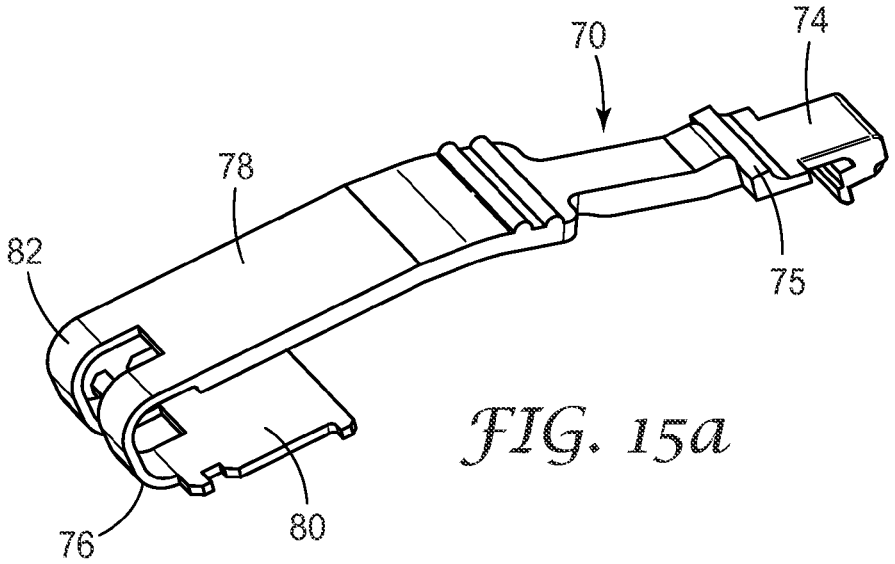
FIG. 15A is a perspective view of an arm.
Figure 15B:
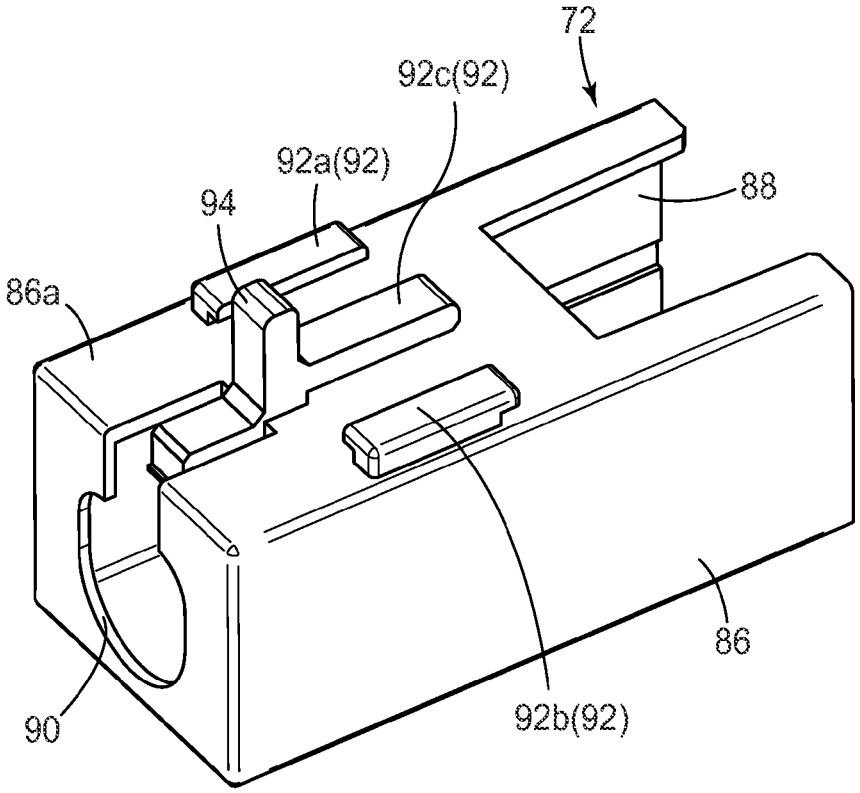
FIG. 15B is a perspective view of the case.
Figure 16:
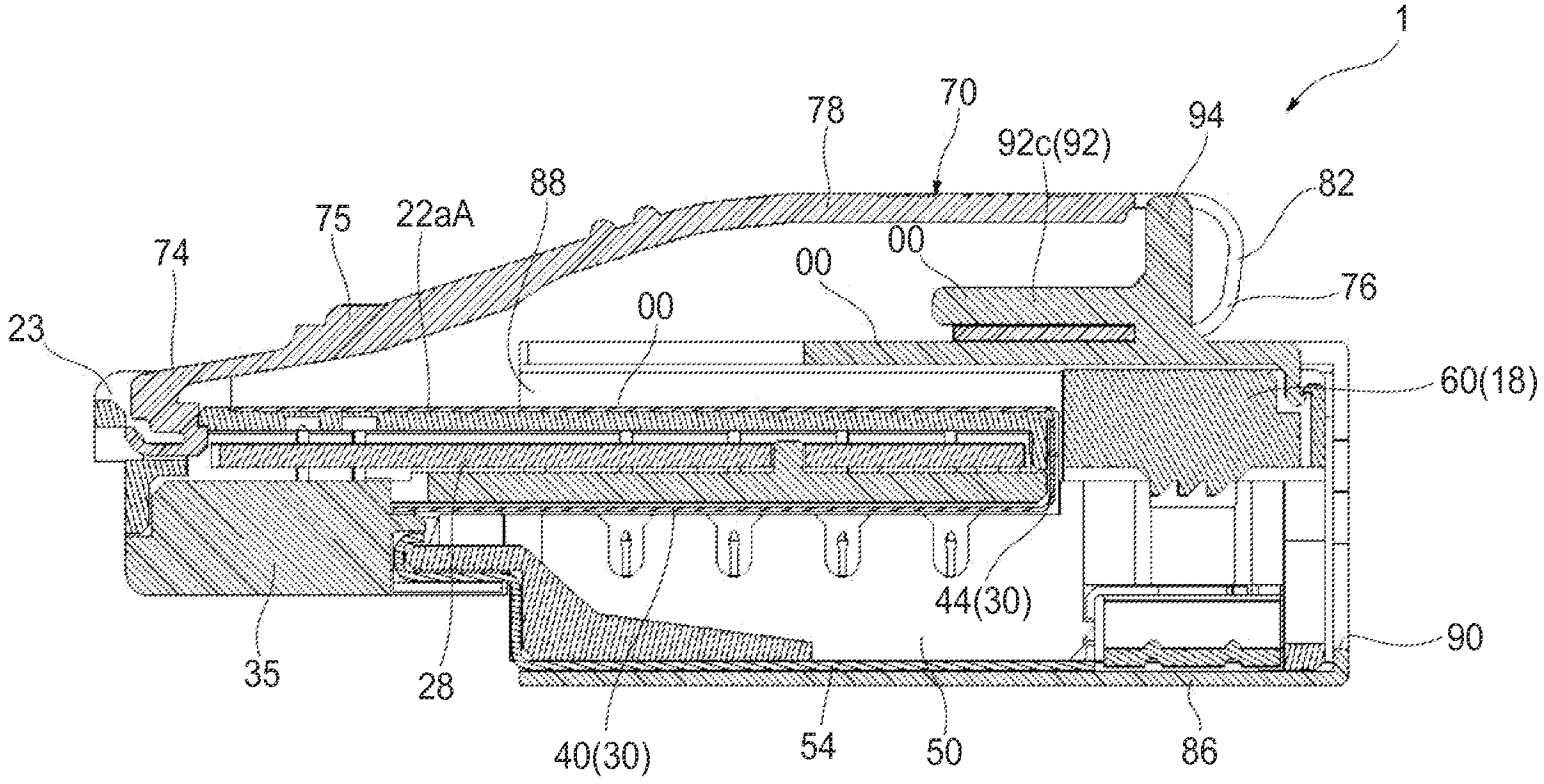
FIG. 16 is a sectional view illustrating the electrical connector shown in FIG. 1.

The case 12 will now be described. FIG. 15A is a perspective view of an arm; FIG. 15B is a perspective view of the case. FIG. 16 is a sectional view illustrating the electrical connector shown in FIG. 1.

As shown in FIGS. 15 and 16, the case 12 has an arm 70 and a case 72. The case 12 is formed from an industrial-use plastic material, such as polybutylene terephthalate, polyamide, or the like, for example. The arm 70 is flexible and detachably fastens the module 10 to the case 12.

The arm 70 is composed of a leading-end portion (a second end portion) 74, a base-end portion (a first end portion) 76 at an opposite side of the leading-end portion 74, and a linking portion (a central portion) 78 that links the leading-end portion 74 and the base-end portion 76. The leading-end portion 74, the base-end portion 76 and the linking portion 78 are integrated in the arm 70.

The leading-end portion 74 is arranged at an opposite side of the first end portion and is detachably mounted to an exposed portion on the module 10. In other words, the leading-end portion 74 is fastened to the lower housing 22 of the main body 14 in the module 10. That is, it is fastened to the module 10 that is exposed from the case 12. Specifically, the leading-end portion 74 mates with the arm fastening portion 23 of the lower housing 22 and is fastened to the lower housing 22. A latch 75 is arranged at the leading-end portion 74, which is inserted into the plug-insertion port on a modular jack. The latch 75 is formed to be wider than other portions of the leading-end portion 74.

The base-end portion 76 is arranged at another end of the module 10 and is detachably mounted to the case 12. In other words, the base-end portion 76 is fastened to the case 72. The base-end portion 76 is substantially U-shaped and is formed to be wider than the leading-end portion 74. The base-end portion 76 includes a fastened portion 80 and an opening 82. The fastened portion 80 is plate shaped and is formed to be wider than other portions of the base end portion 76. The fastened portion 80 is fastened to the fastening portion 92 on the case 72, described below.

The opening 82 is formed along an extended direction of the arm 70. The opening 82 is substantially rectangular and is arranged in a central area of the arm 70 in the width direction, on the base-end portion 76.

The linking portion 78 is substantially a band shape. The linking portion 78 is formed to be wider than the leading-end portion 74. The linking portion 78 is arranged to be separated from the case 72, separated by predetermined space from the case 72.

The case 72 has a substantially hollow, rectangular, parallelepiped shape. The case 72 includes a case body 86 that demarcates the storage space S4 (see FIG. 5) that houses the module 10. The case body 86 includes an opening 88 where the module 10 is inserted, provided at another side of the case body 86, and a cable-insertion unit 90 where the cable 3 is inserted, provided at one side of the case body 86. Also, the case 72 includes a fastening portion 92 that fastens the base portion 76 of the arm 70, provided at one side face 86*a* of the case body 86, and a stopper (projection) 94 provided projecting from the one side face 86*a* of the case body 86.

The fastening portion 92 fastens the fastening portion 80 of the base portion 76 of the arm 70. The fastening portion 92 includes first and second portions 92*a* and 92*b* arranged at both sides in the width direction, in the side face 86*a* of the case body 86, and a third portion 92*c* arranged between the first and second portions 92*a* and 92*b*. The first to the third portions 92*a* to 92*c*, together with the one side face 86*a* of the case body 86, demarcate a space of an adequate thickness in the fastened portion 80 therebetween, and include a configuration that interposes the fastened portion 80 between the one side face 86*a* of the case body 86.

The stopper 94 is substantially a pillar shape and projects upward from the one side face 86*a* of the case body 86. The stopper 94 is arranged substantially in the center of the width direction, toward a back side, on the one side face 86*a* of the case body 86. The stopper 94 is positioned at the opening 82 of the base portion 76 of the arm 70. The stopper 94 is a member that restricts bending of the arm 70 and restricts the amount of bending (movement) of the linking portion 78, so that the linking portion 78 is not pressed in the downward direction (toward the case 12 side) beyond a predetermined amount. In other words, the stopper 94 restricts the base portion 76 from excessively bending.

In this way, through the stopper 94, the linking portion 78 is not pressed in a downward direction beyond a fixed amount when the arm 70 is pressed in the case 12. With this, it is possible to prevent an excessive load from being applied to the base portion 76 of the arm 70. Therefore, the base portion 76 of the arm 70 is prevented from being damaged.

An end side (back end) of the module 10 is housed in the case body 86 of the case 12, and the other end side (front end) is exposed outside of the case body 86. Specifically, the connector 35 of the main body 14 is exposed and the clamp 18 is housed in the case body 86 in the case 12, on the module 10. In other words, the clamp 18 is placed in a position adjacent to the other end of the module 10.

Figure 18A:
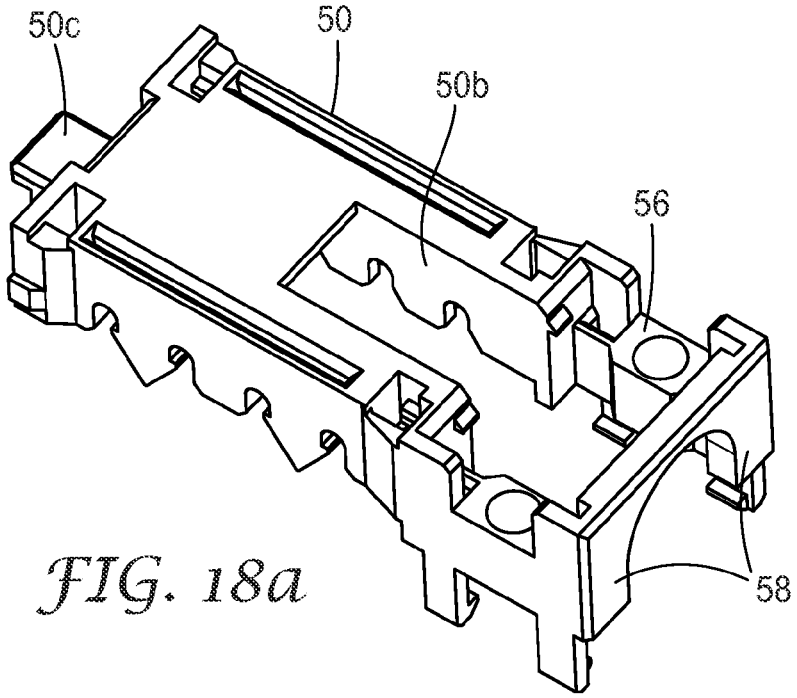
FIGS. 18A through 18D are views illustrating an assembly procedure of the module.
Figure 18B:
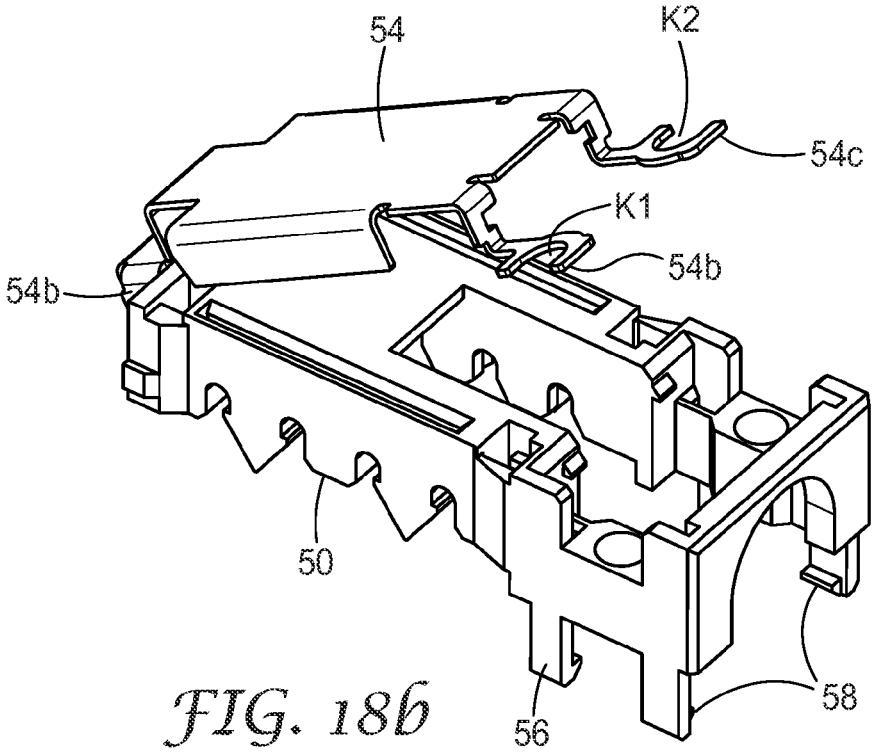
Figure 18C:
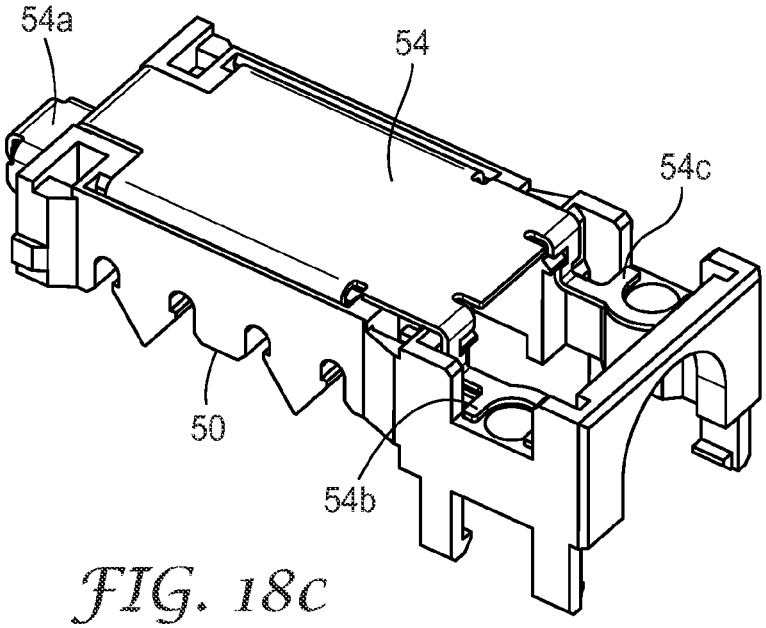
Figure 18D:
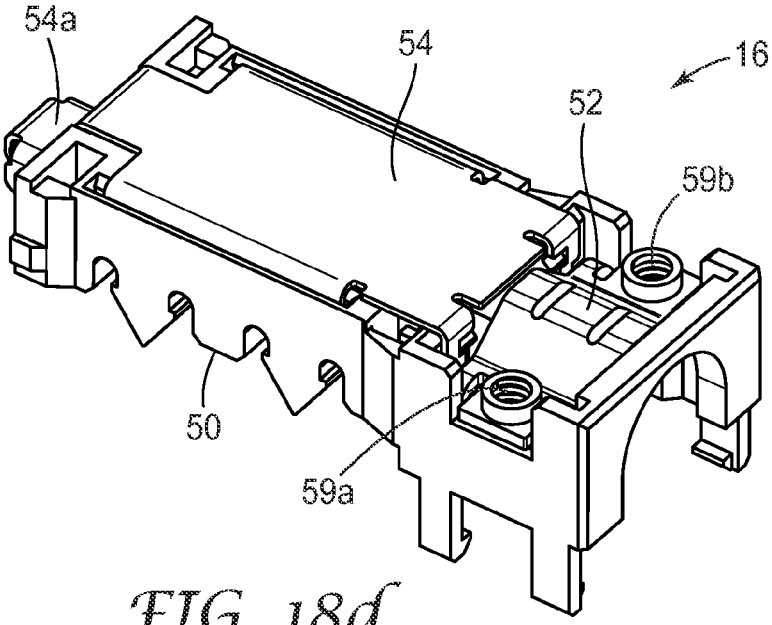
Figure 19A:
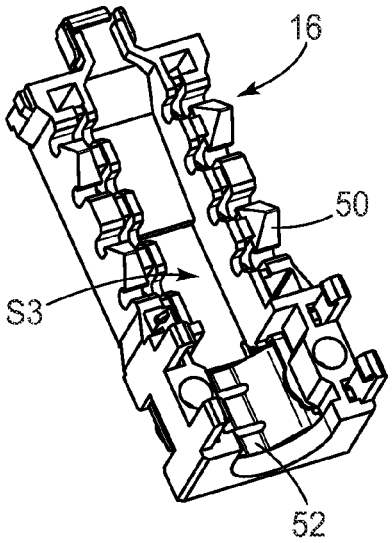
FIGS. 19A through 19D are views illustrating a procedure for attaching the cable to the cover.
Figure 19B:
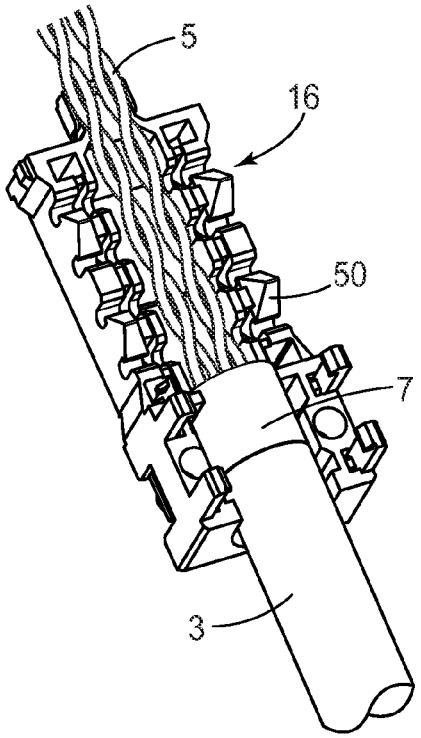

Next, a method of assembly for the electrical connector 1 will be described. FIGS. 17A through 17D are views illustrating an assembly procedure for the main body in the module. FIGS. 18A through 18D are views illustrating an assembly procedure of the module. FIGS. 19A through 19D are views illustrating a procedure for attaching the cable to the cover. FIGS. 20A through 20C are views illustrating an assembly procedure for the main body and case.

Figure 17A:
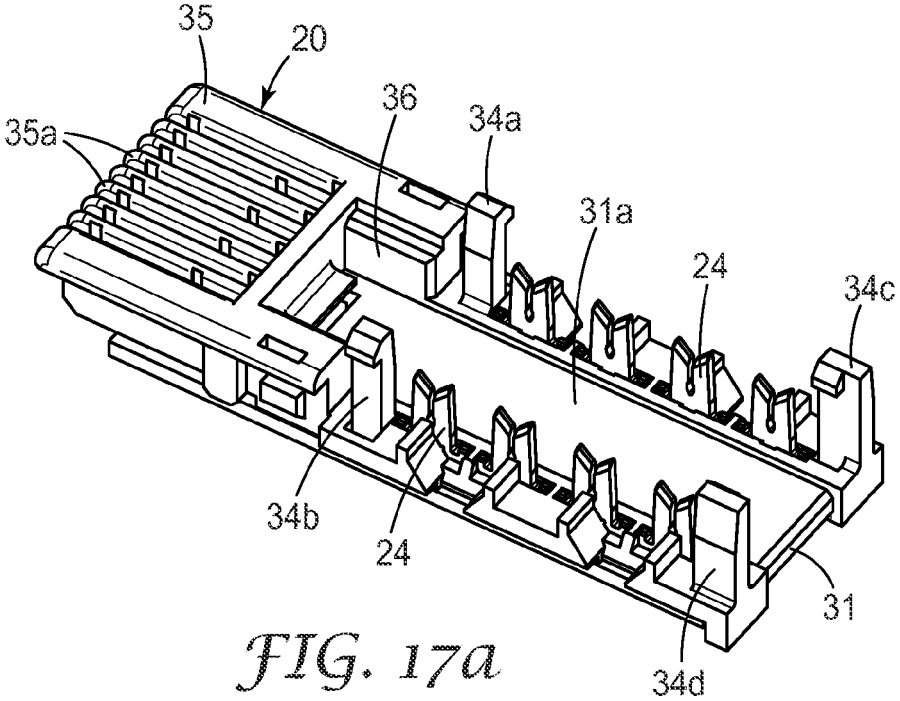
FIGS. 17A through 17D are views illustrating an assembly procedure for the main body in the module.
Figure 17B:
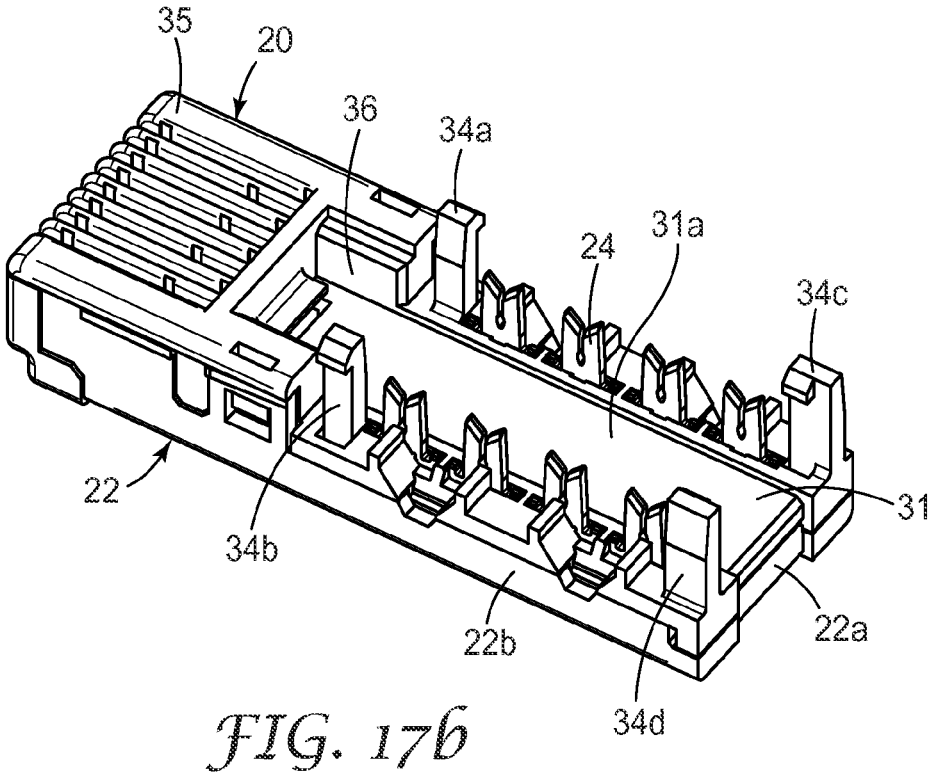
Figure 17C:
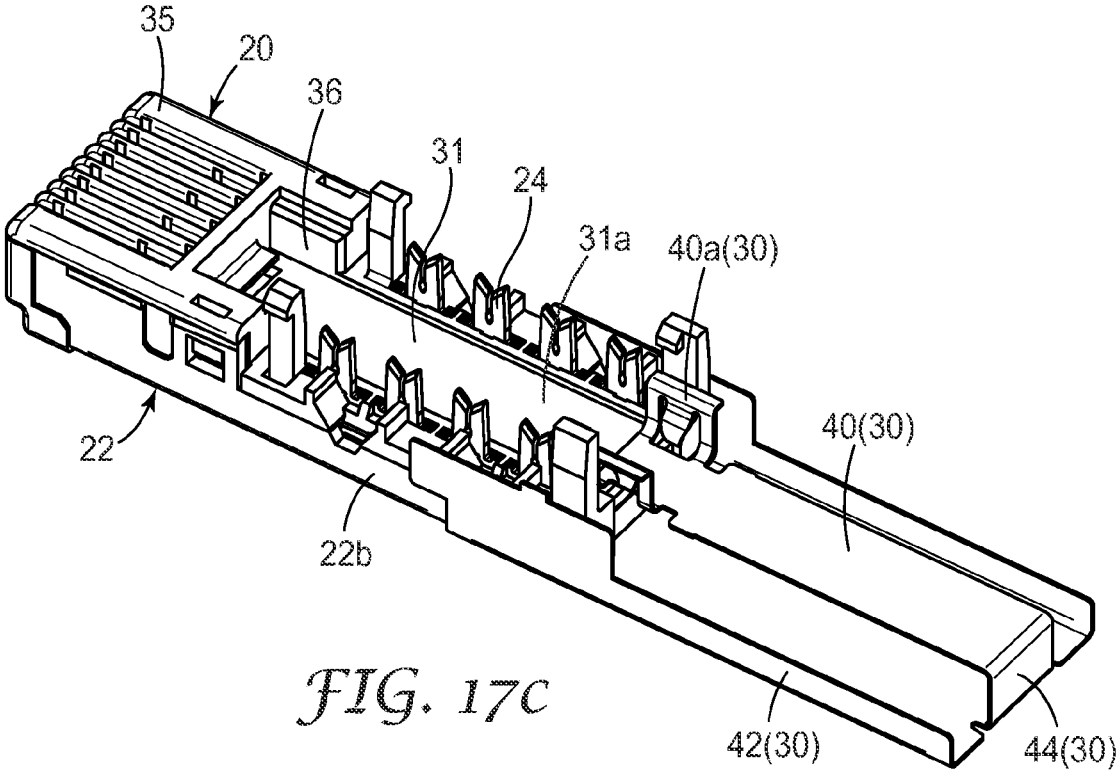
Figure 17D:
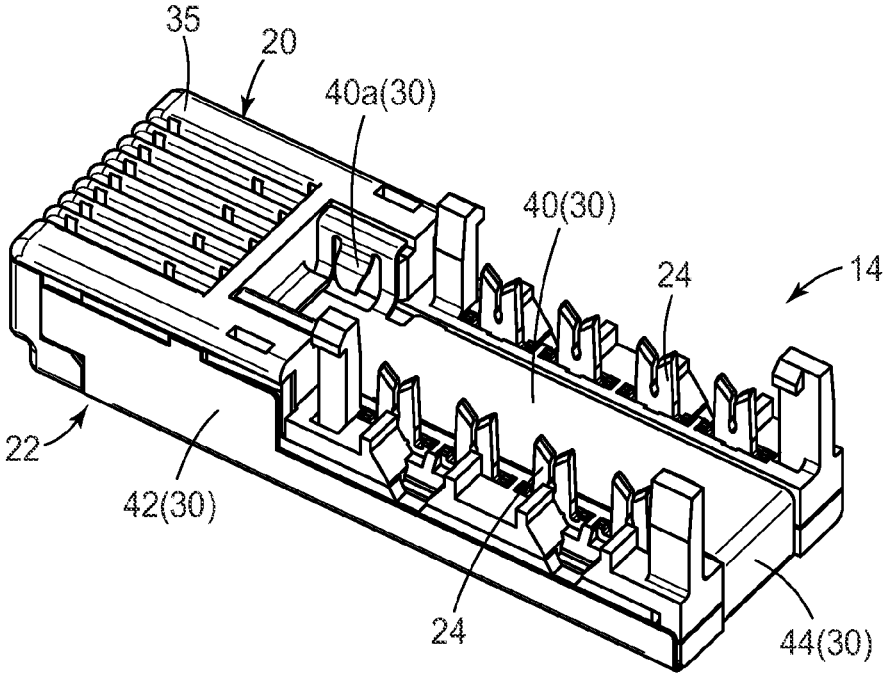

The assembly method of the main body 14 will be described first. As shown in FIG. 17A, the wiring substrate 28 is arranged under the upper housing 20. Next, as shown in FIG. 17B, the lower housing 22 is placed under the wiring substrate 28, and the upper housing 20 and the lower housing 22 are joined. Continuing on, as shown in FIG. 17C, one end of the first shield member 30 is inserted so as to interpose the upper housing 20 and the lower housing 22. In this way, the main body 14 is assembled, as shown in FIG. 17D.

Next, the assembly method of the cover 16 will be described. As shown in FIG. 18A, the wire guide 50 is prepared. Next, as shown in FIGS. 18B and 18C, the locking portion 54*a* of the second shield member 54 is attached to the locking portion 50*c* of the wire guide 50. Next, as shown in FIG. 18D, the cable bearing 52 is attached to the positioning unit 56 of the wire guide 50 and the cover 16 is assembled.

Next, the method for attaching the cable 3 to the cover 16 will be described. As shown in FIG. 19A, the cover 16 is prepared. Next, the cable 3 is arranged in the cover 16, as shown in FIG. 19B. The twisted cable 5 is exposed by peeling back the jacket cover on the end of the cable 3 and the shield 7 is also exposed. Next, the shield 7 is positioned on the cable bearing 52 of the cover 16, and the cable 3 is arranged on the cover 16 so that the twisted cable 3 is positioned at the storage space S3 of the wire guide 50.

Figure 10A:
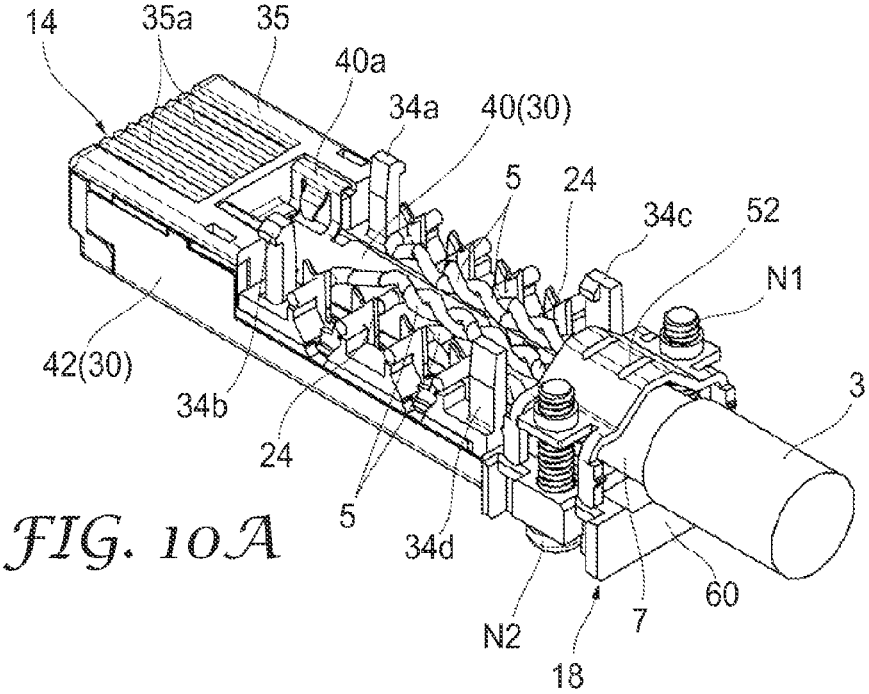
FIGS. 10A through 10C are perspective views of the cable in a state attached to the main body.
Figure 10B:
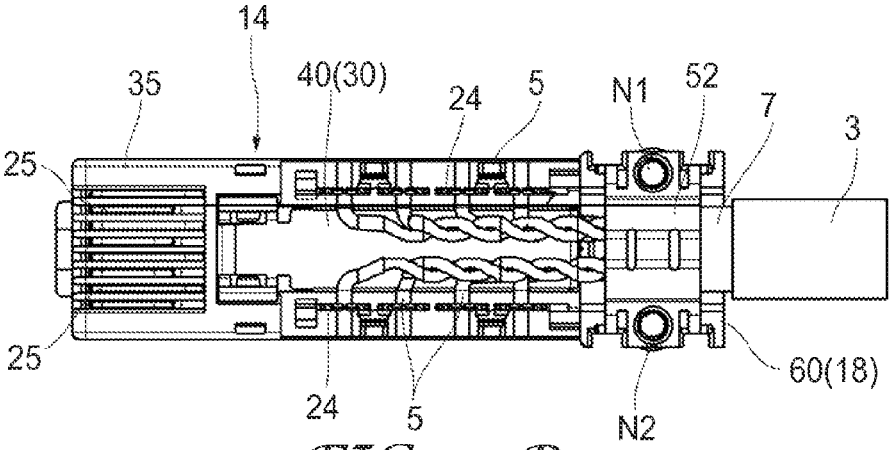
Figure 10C:
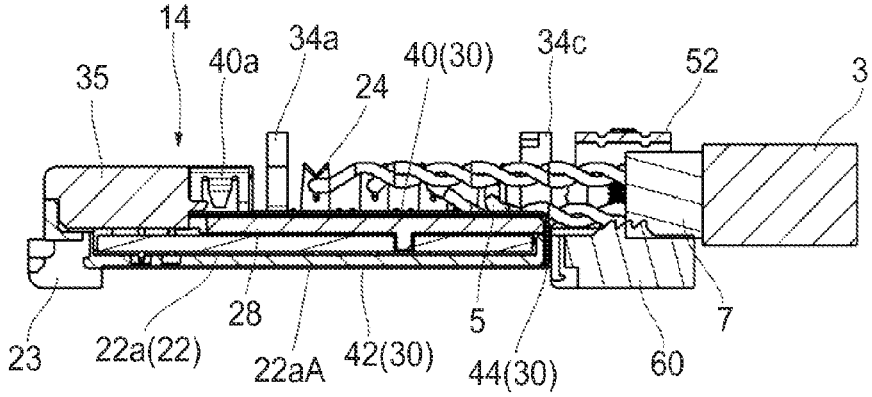
Figure 19C:
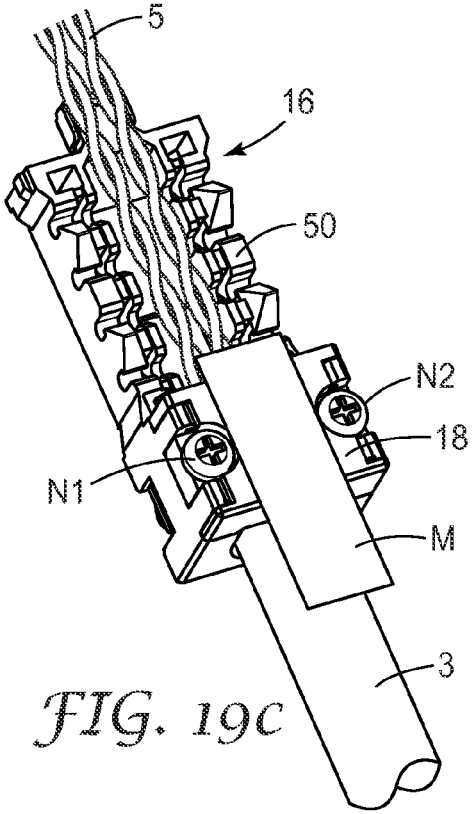
Figure 19D:
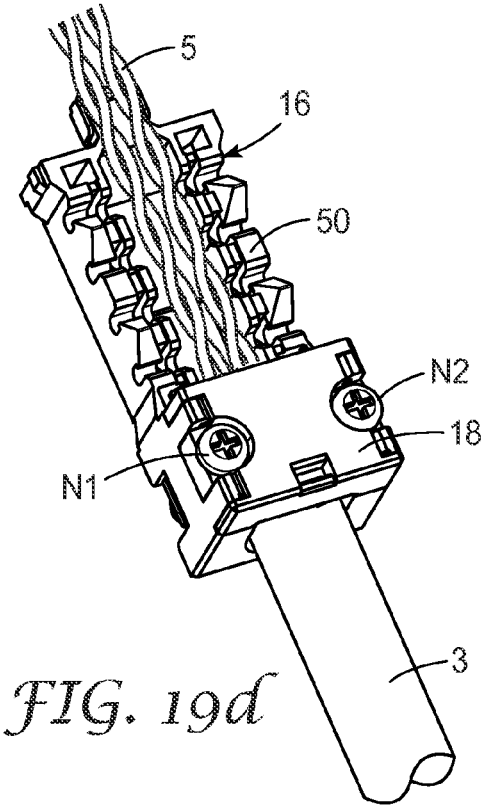
Figure 20A:
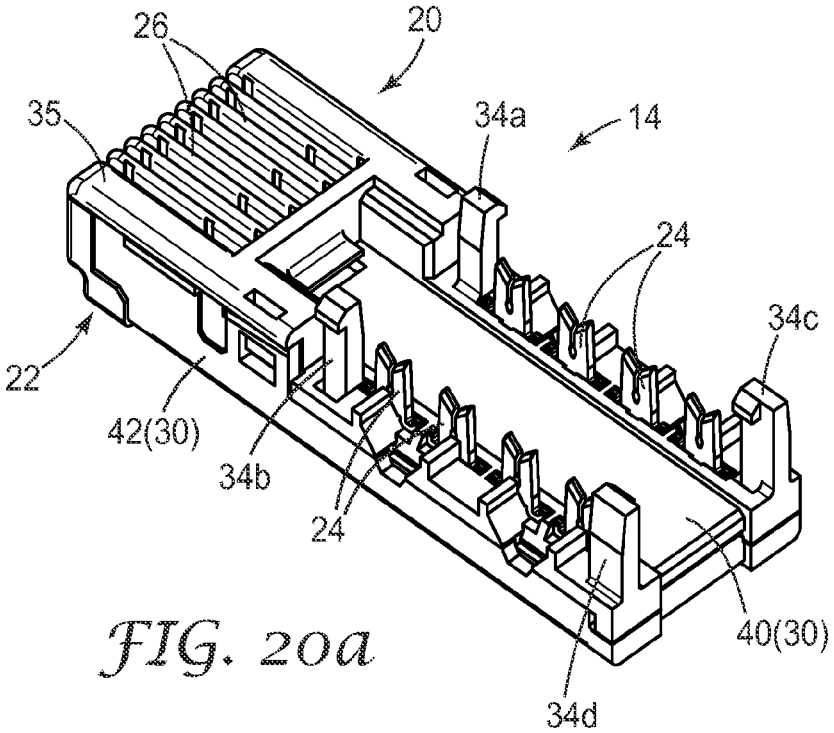
FIGS. 20A through 20C are views illustrating an assembly procedure for the main body and case.
Figure 20B:
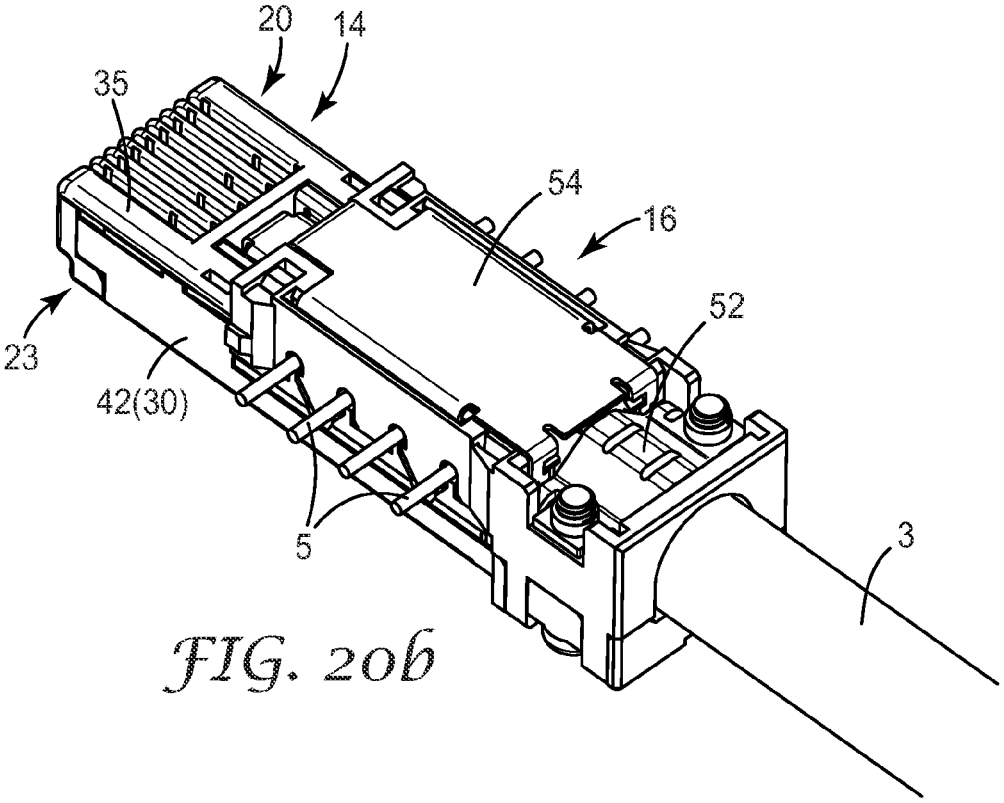
Figure 20C:
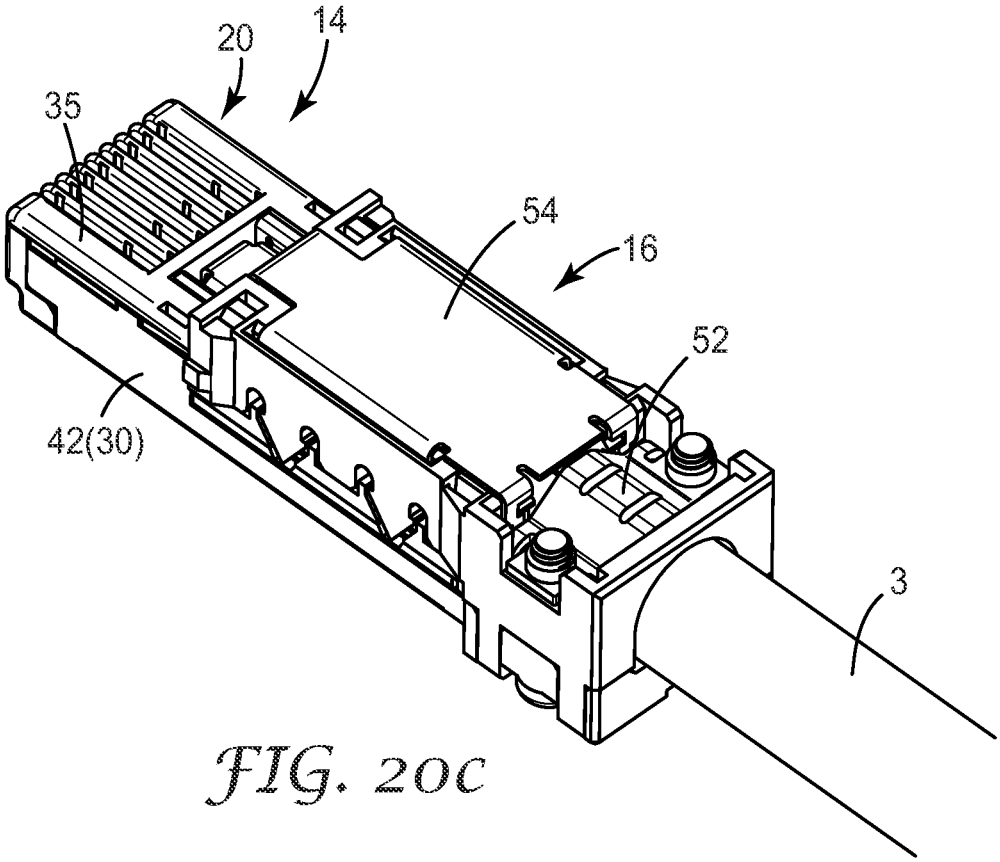

Next, as shown in FIG. 19C, the clamp 18 is placed on the cover 16. Then, as shown in FIG. 19D, the cable clamp 60 is attached to the cover 16 using the screws N1 and N2. This interposes the cable 3 between the cover 16 and the clamp 18, and fastens the cable 3 to the cover 16 and the clamp 18. Then, the twisted cable 5 is arranged in the guide groove 51 of the wire guide 50, so that the twisted cable 5 is arranged as shown in FIG. 10.

Next, the main body 14 is prepared, as shown in FIG. 20A. Next, as shown in FIG. 20B, the cover 16 that holds the cable 3 is attached to the main body 14. Specifically, the main body 14 and the cover 16 are integrated. At that time, the locking portions 34*a* to 34*d* of the main body 14 lock with the cover 16. With this, the main body 14 and case 12 are joined. Also, the twisted pair cable 5 is pressed into the contacts 24, thereby electrically connecting the conductor of the twisted pair cable 5 and the contacts 24. Also, as shown in FIG. 20C, any excess portion of the twisted pair cable 5 can be cut.

Lastly, the case 12 is inserted into the module 10 (assembled as described above) from the cable 3 side, and the fastened portion 74*a* of the leading end portion 74 of the arm 70 is attached to the arm fastening portion 23 of the main body 14. In this way, the cable 3 is attached to the electrical connector 1.

As described above, pursuant to the embodiment, the upper portion 40 of the first shield member 30 is arranged between the twisted pair cable 5 of the cable 3 and the wiring substrate 28. With this configuration, electromagnetic effects between the twisted pair cable 5 of the cable 3 and the connecting conductor wiring L of the wiring substrate 28 are reduced and electromagnetic interference is suppressed. Therefore, this suppresses cross-talk that occurs between the twisted pair cable 5 and the connecting conductor wiring L. This results in suppressing the generation of noise in electrical connector 1.

Also, the first shield member 30, the second shield member 54, and the cable bearing 52 are electrically connected, and the cable bearing 52 is electrically connected to the shield 7 of the cable 3. With this, the first shield member 30 has a ground potential via the second shield member 54 and the cable bearing 52, and the potential is stabilized. Therefore, through the first shield member 30, the electrical connector 1 effectively suppresses cross-talk.

Moreover, pursuant to the embodiment, the cable bearing 52 is provided with both a function for electrically connecting to the shield 7 of the cable 3 and a function for fastening the cable 3. Therefore, a more compact electrical connector 1 is provided, compared to providing individual parts including a portion that electrically connects to the shield 7 and a portion that fastens the cable 3.

Also, with this embodiment, both ends of the arm 70 are fastened in the case 12. Because displacement (folding back) in a direction opposite to the direction of displacement (toward the case 12 side) is prevented, just as in a case having only one side fastened, it is possible to prevent damage to the arm 70.

Also, the stopper 94 is formed on the case 12. This prevents excessive bending of the linking portion 78 on the arm 70, and this prevents an excessive load being applied to the base portion 76. Therefore, it is possible to prevent the base portion 76 from being damaged.

An embodiment of the present invention was described above as an explanation, however, this is not to be construed to be a limitation on the present invention. A variety of modifications can be implemented without deviating from the spirit of the invention.

Item 1 is an electrical connector attached to a cable, comprising:

a main body; and a cover;

the main body and the cover demarcating a space for storing the cable;

the body comprising:

an upper housing;

a lower housing;

a wiring substrate arranged between the upper housing and the lower housing; and a shield member arranged interposing the upper housing and the lower housing; and the wiring substrate comprising:

a contact for electrically connecting to the cable;

a connection terminal for electrically connecting to a mating connector; and wiring for electrically connecting the contact and the connection terminal.

Item 2 is the electrical connector according to item 1, wherein the shield member comprises:

a first portion arranged at a top side of the upper housing and between opposing contacts; and a second portion arranged at a bottom side of the lower housing.

Item 3 is the electrical connector according to item 1, further comprising a clamp for fastening the cable to the cover.

Item 4 is the electrical connector according to item 1, wherein the contacts include a portion that projects from the wiring substrate in an external direction.

Item 5 is an electrical connector comprising:

a case housing internally one end of a module, and holding the module by exposing another end of the module to an outside; and an arm that detachably fastens the module to the case;

the arm comprising:

a first end portion arranged at the other end of the module, detachably attached to the case;

a second end portion arranged at an opposite side of the first end portion, detachably attached to the exposed portion of the module; and a central portion the connects the first end portion and the second end portion;

the case being arranged between the first end portion and the second end portion, and comprising a projection that restricts a movement of the arm to the case side.

Item 6 is the electrical connector according to item 5, wherein the module comprises:

a main body;

a cover; and a clamp for fastening the cable to the cover;

the clamp being arranged at the other end of the module in the case.

Item 7 is the electrical connector according to item 6, further comprising a first shield member that covers the main body; and a second shield member that covers the cover;

the first shield member and the second shield member being electrically connected.

EXPLANATION OF ITEM NUMBERING

1: electrical connector; 3: cable; 10: module; 12: case; 14: body; 16 cover; 18: clamp; 20: upper housing; 22 lower housing; 24 contact; 26: connection terminal; 28: wiring substrate; 30: first shield member (shield member); 40: upper portion (first portion); 42: lower portion (second portion); 54: second shield member; 70: arm; 74: leading end portion (first end); 76: base end portion (second end); 78: linking portion (central portion); 94: stopper (projection); L: connecting conductor wiring (wiring).

What is claimed is:

1. An electrical connector attached to a cable, comprising:

a main body; and a cover assembled to the main body;

the main body and the cover demarcating a space for storing the cable;

the body comprising:

an upper housing;

a lower housing;

a wiring substrate arranged between the upper housing and the lower housing; and a shield member arranged interposing the upper housing and the lower housing; and the wiring substrate comprising:

opposing contacts for electrically connecting to the cable;

connection terminals for electrically connecting to a mating connector; and wiring for electrically connecting the contacts and the connection terminals, wherein the shield member includes:

a first portion arranged at a top side of the upper housing and between the opposing contacts; and a second portion arranged at a bottom side of the lower housing.

2. The electrical connector according to claim 1, further comprising a clamp for fastening the cable to the cover.

3. The electrical connector according to claim 1, wherein the contact includes a portion that projects from the wiring substrate in an external direction.

4. An electrical connector comprising:

a case housing internally one end of a module, and holding the module by exposing another end of the module to an outside;

a main body;

a first shield member that covers the main body and including a first portion arranged between opposing contacts of the main body; and an arm that detachably fastens the module to the case;

the arm comprising:

a first end portion arranged at the other end of the module, detachably attached to the case;

a second end portion arranged at an opposite side of the first end portion, detachably attached to the exposed portion of the module; and a central portion that connects the first end portion and the second end portion;

the case comprising a projection that restricts a movement of the arm toward the case.

5. The electrical connector according to claim 4, wherein the module comprises:

a cover, the main body and the cover demarcating a space for the cable; and a clamp for fastening the cable to the cover;

the clamp being arranged at the other end of the module in the case.

6. The electrical connector according to claim 5, further comprising a second shield member that covers the cover;

the first shield member and the second shield member being electrically connected.

7. An electrical connector, comprising:

a main body comprising:

an upper housing;

a lower housing;

a wiring substrate arranged between the upper housing and the lower housing, the wiring substrate comprising:

first contacts along a first side of the wiring substrate;

second contacts along a second side of the wiring substrate, the first and second contacts configured to connect to a cable;

connection terminals configured to electrically connect to a mating connector; and wiring that electrically connects each contact with a connection terminal; and a first shield member comprising a first portion between the first contacts and the second contacts and a second portion at a bottom side of the lower housing.

8. The electrical connector of claim 7, wherein the first shield member further comprises a linking portion between the first portion and the second portion.

9. The electrical connector of claim 7, further comprising a cover assembled to the main body, the main body and the cover demarcating a space for the cable between the main body and the cover, wherein the cover includes a second shield member.

10. The electrical connector of claim 9, wherein:

the first shield member includes a locking portion; and the second shield member includes a locking portion that locks with the locking portion of the first shield member, the locking portion of the first shield member and the locking portion of the second shield member physically and electrically connecting the first shield member and the second shield member.

11. The electrical connector of claim 9, further comprising a cable bearing configured to electrically connect the first shield member and the second shield member to a shield of the cable.

12. The electrical connector of claim 11, wherein the second shield member includes contact portions configured to electrically and physically connect the second shield member to the cable bearing.

13. The electrical connector of claim 9, further comprising a clamp for fastening the cable to the cover.

14. The electrical connector of claim 13, wherein the main body, the cover, and the clamp are components of a module and further comprising a case that houses internally one end of the module exposes another end of the module to an outside.

15. The electrical connector of claim 14, further comprising an arm that detachably fastens the module to the case.

16. The electrical connector of claim 15, wherein the arm comprises:

a first end portion, detachably attached to the case;

a second end portion, detachably attached to the exposed portion of the module.

17. The electrical connector of claim 15, wherein the case includes a projection that restricts movement of the arm toward the case.

18. The electrical connector of claim 17, wherein the projection comprises a pillar extending from a center of the case along a width direction.

* * * * *